US011918130B2

(12) United States Patent
Burden

(10) Patent No.: US 11,918,130 B2
(45) Date of Patent: Mar. 5, 2024

(54) DUAL CHAMBERED CANTEEN WITH INTERCHANGEABLE LIDS

(71) Applicant: Gwendolyn Burden, Pearland, TX (US)

(72) Inventor: Gwendolyn Burden, Pearland, TX (US)

( * ) Notice: Subject to any disclaimer, the term of this patent is extended or adjusted under 35 U.S.C. 154(b) by 472 days.

(21) Appl. No.: 16/841,673

(22) Filed: Apr. 6, 2020

(65) Prior Publication Data

US 2021/0030176 A1 Feb. 4, 2021

Related U.S. Application Data

(63) Continuation-in-part of application No. 15/064,822, filed on Mar. 9, 2016, now abandoned.

(51) Int. Cl.
*A47G 19/22* (2006.01)
*B65D 25/04* (2006.01)
(Continued)

(52) U.S. Cl.
CPC ..... *A47G 19/2272* (2013.01); *A47G 19/2222* (2013.01); *B65D 25/04* (2013.01); *B65D 47/065* (2013.01); *B65D 81/3869* (2013.01)

(58) Field of Classification Search
CPC ..... A47G 19/2272; A47G 19/2222; A47G 2019/122; A47G 19/2288; A47G 19/2266; A47G 21/183; B65D 25/04; B65D 47/065; B65D 81/3869; B65D 2543/00046; B65D 81/3283; B65D 47/06; B65D 47/305; Y10T 29/49002; A45F 3/18
USPC ..... 220/553, 669, 23.83, 324, 254.2, 625, 220/507, 822, 378, 254.3, 523–526, 220/254.4; 215/387, 388, 6, 313
See application file for complete search history.

(56) References Cited

U.S. PATENT DOCUMENTS 3,705,661 A * 12/1972 Davis ..... A47J 41/02 220/592.16
5,477,994 A * 12/1995 Feer ..... B65D 47/305 137/846

(Continued)

FOREIGN PATENT DOCUMENTS

KR 200466313 Y1 * 4/2013 ..... A47G 19/22

*Primary Examiner* — John K Fristoe, Jr.
*Assistant Examiner* — John Martin Hoppmann
(74) *Attorney, Agent, or Firm* — Delphine James

(57) ABSTRACT

The dual-chambered liquid container canteen of the present invention includes a dual-chambered container with a vertical partition separating each chamber, the dual-chambered liquid container of the present invention includes a dual-chambered container with a vertical partition separating each chamber, three interchangeable lids with two separate non-removable inner wall compartments that fits inside each chamber of the container and securely separate the liquids while ensuring proper positioning of the lid over each compartment. A gasket molded into the rim of the container and vertical partition of the container to ensure a liquid airtight seal between each chamber and the lid, a gasket molded into the rim of the container and vertical partition of the container to ensure a liquid tight seal between each chamber and the lid, each lid has release holes for venting the container chambers to atmosphere as liquids are dispersed from the container.

10 Claims, 30 Drawing Sheets

(51) Int. Cl.
*B65D 47/06* (2006.01)
*B65D 81/38* (2006.01)

(56) References Cited

U.S. PATENT DOCUMENTS 5,813,566 A * 9/1998 Bradford ..... B65D 85/185
220/653
6,341,716 B1 * 1/2002 Goettner ..... B65D 47/305
222/145.5
7,975,868 B1 * 7/2011 Flies ..... B65D 1/265
220/524

* cited by examiner

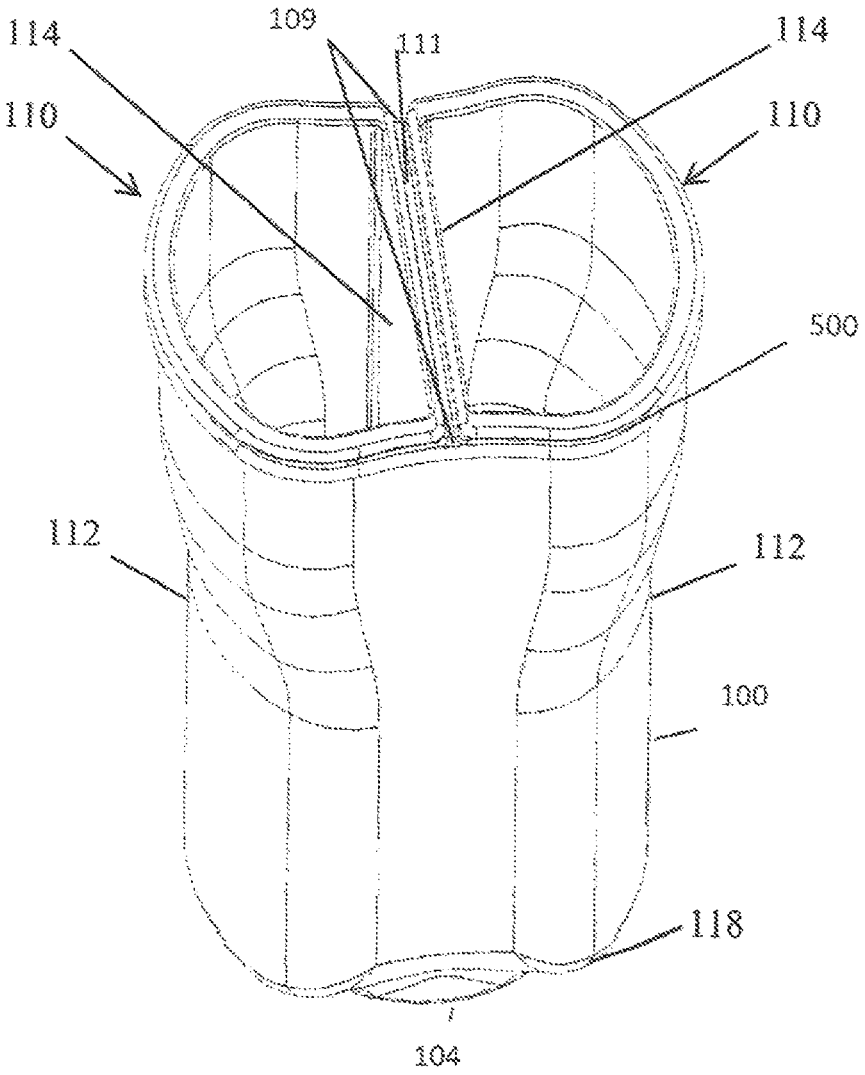
Figure 1 Top and front view of bottle

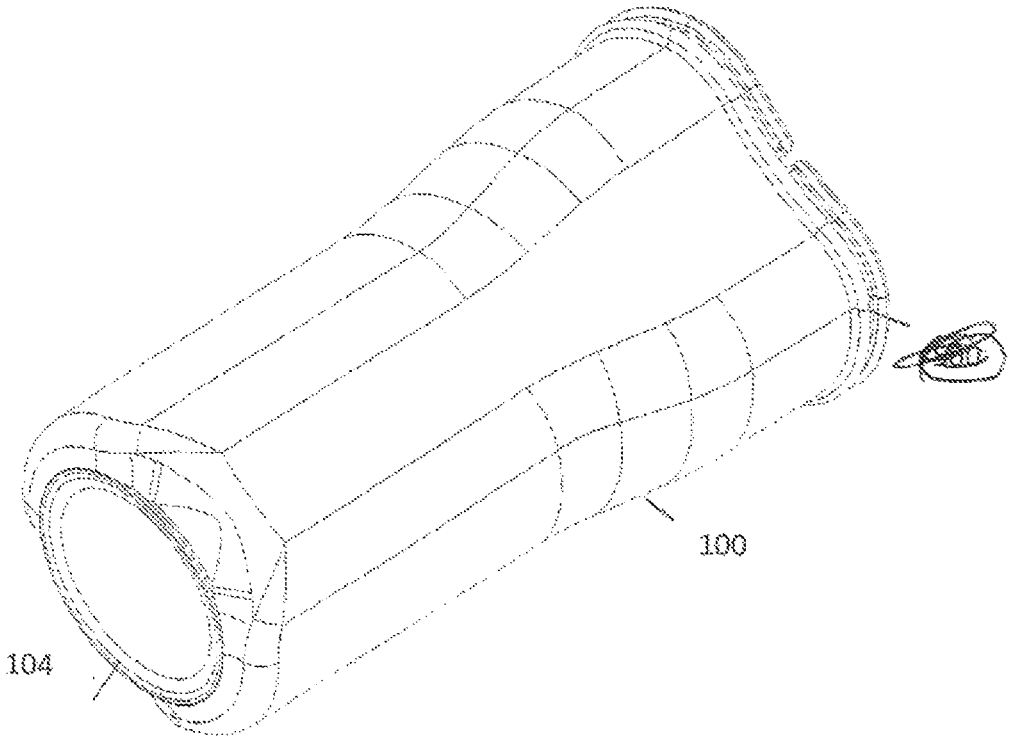
Figure 3 Bottom view of the bottle

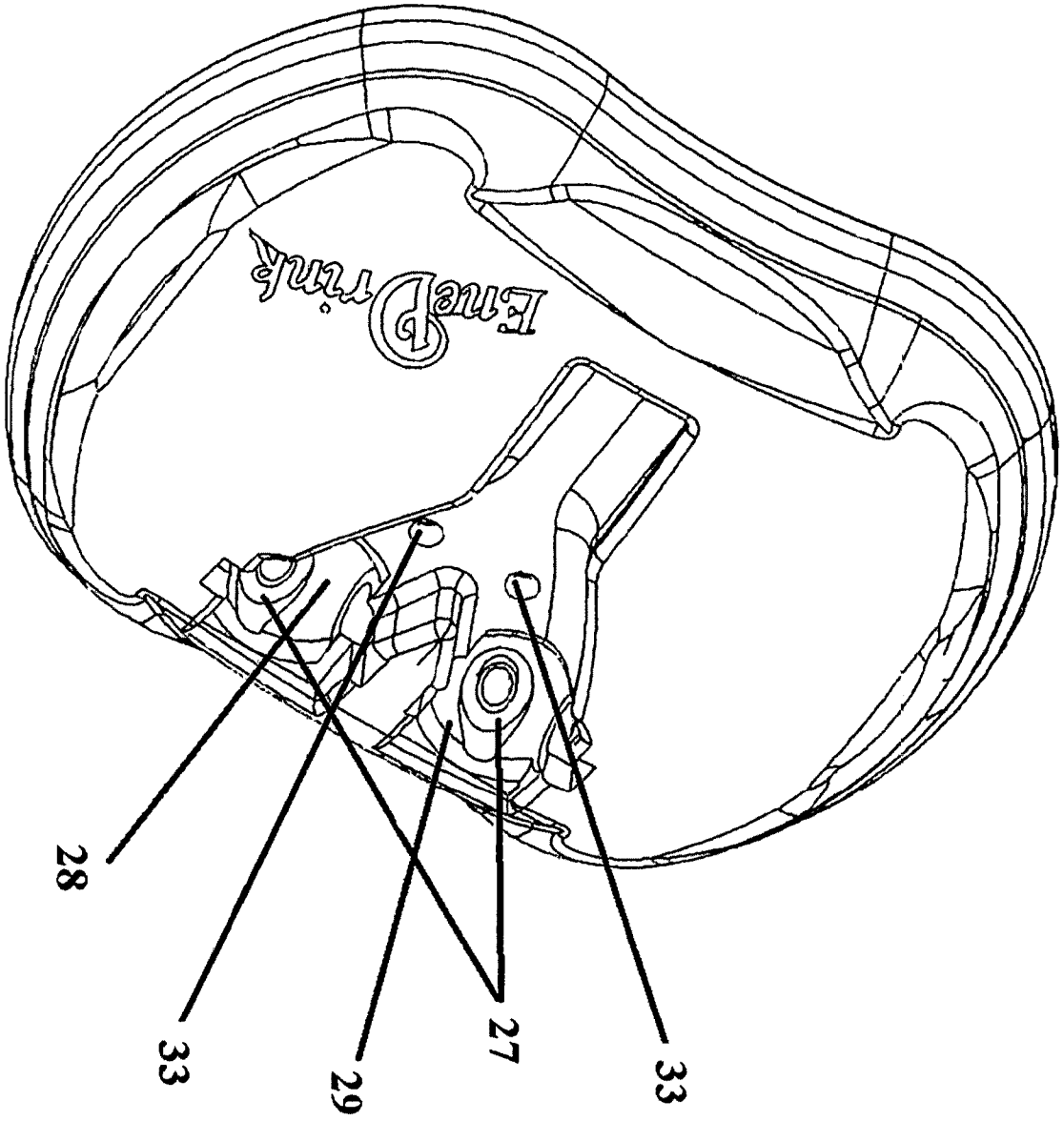
FIG. 6 Top View

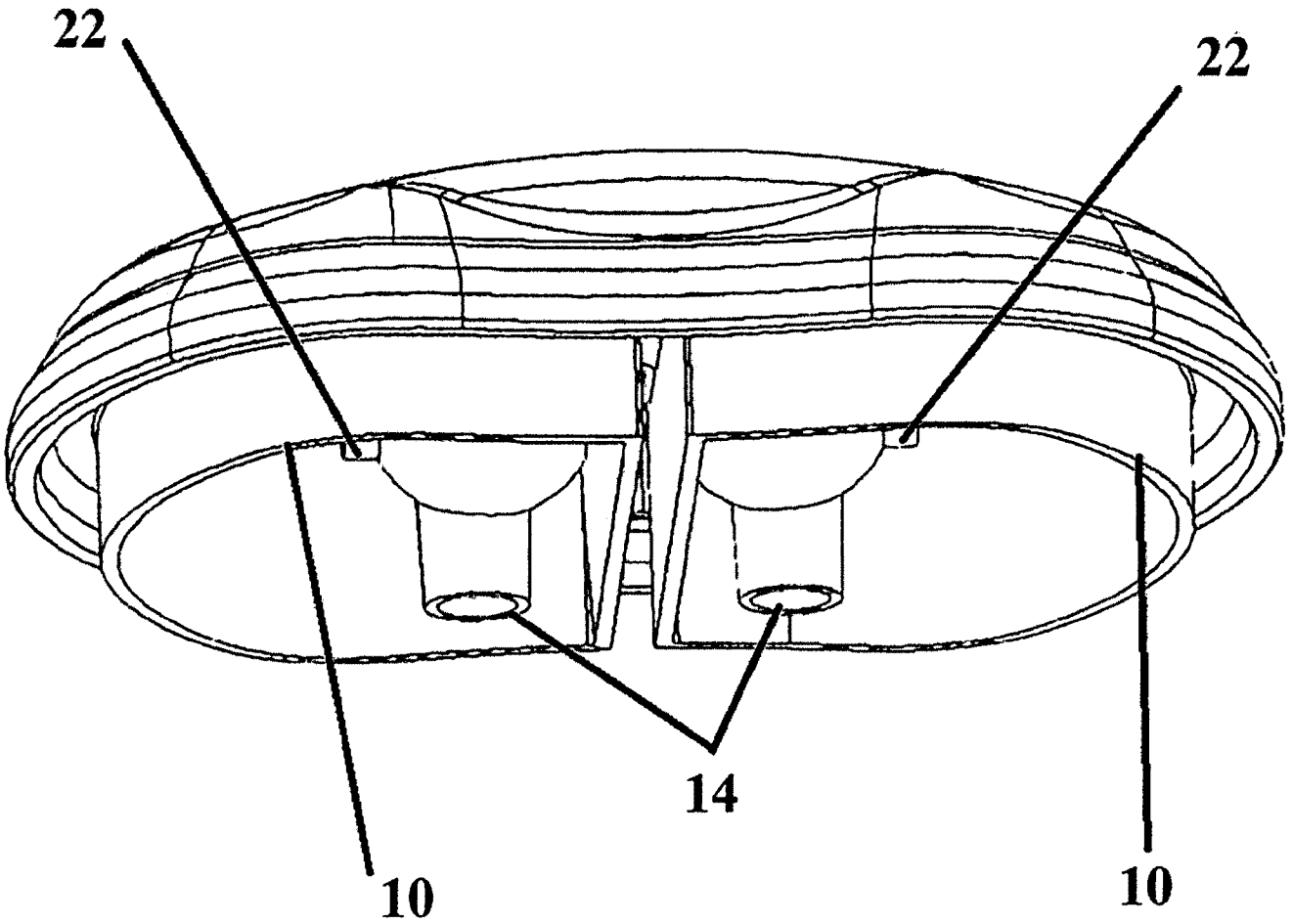
FIG. 7 Side and Bottom View

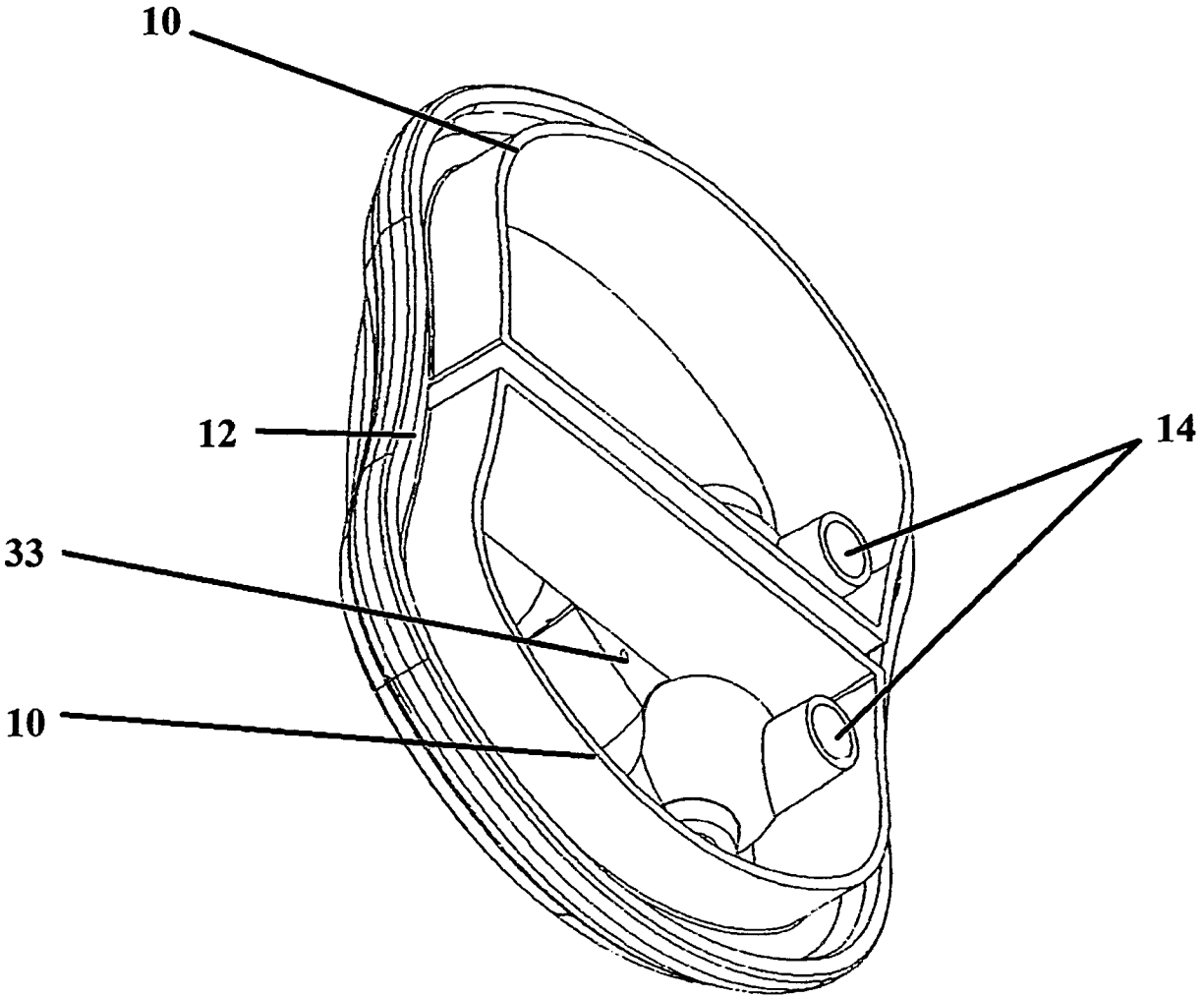
FIG. 8 Bottom View

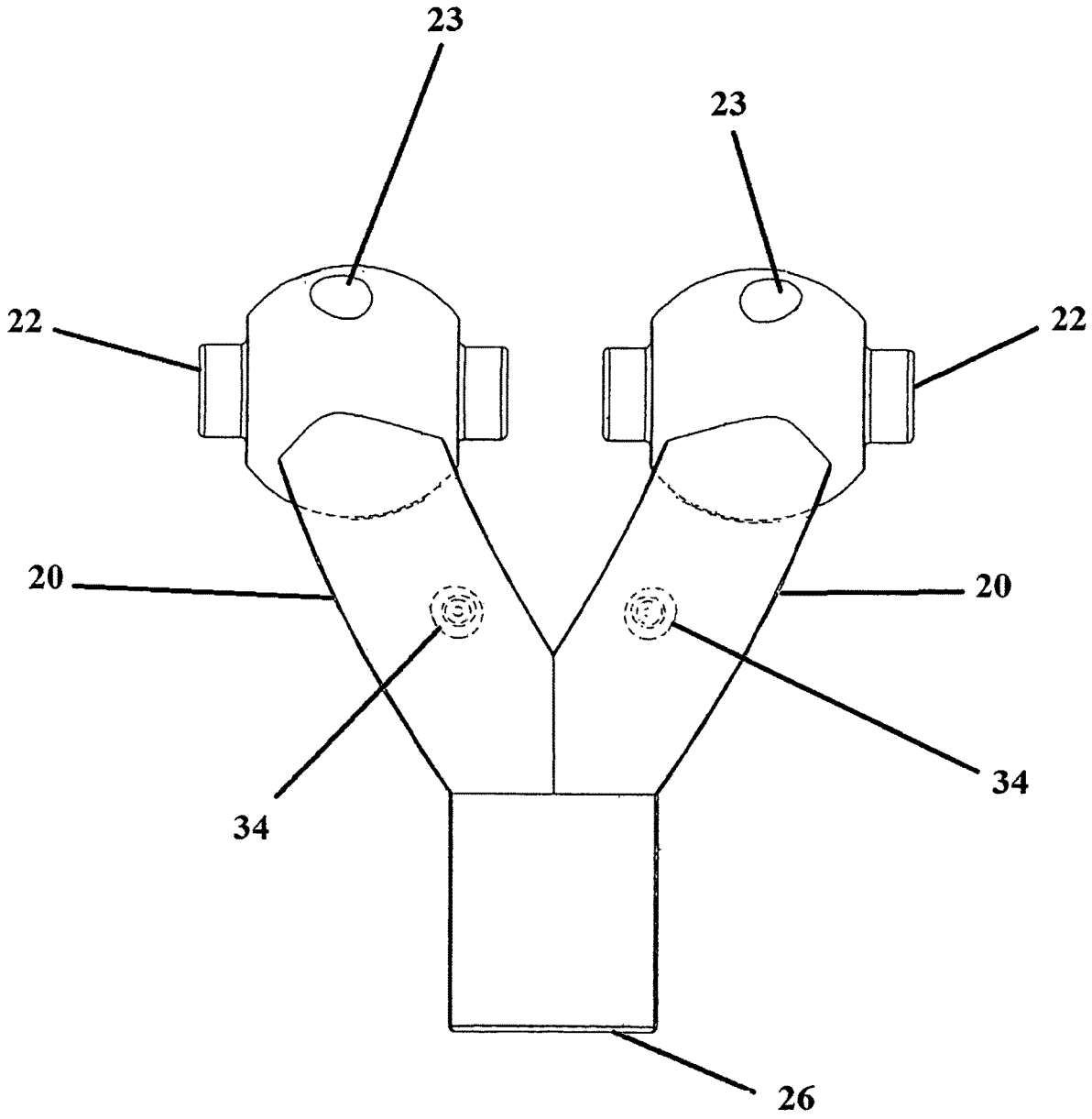
FIG. 9 Perspective View

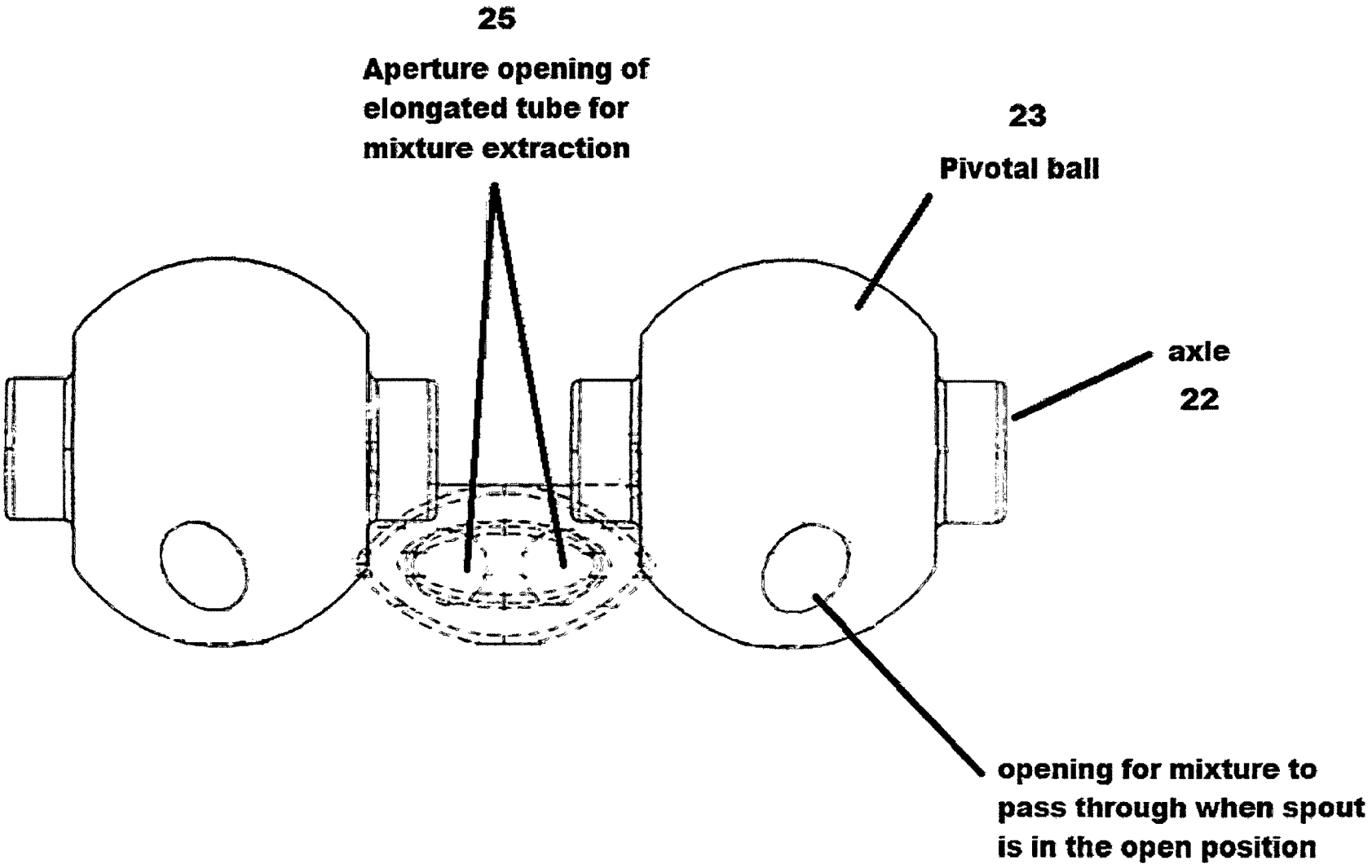
FIG. 10 Perspective View

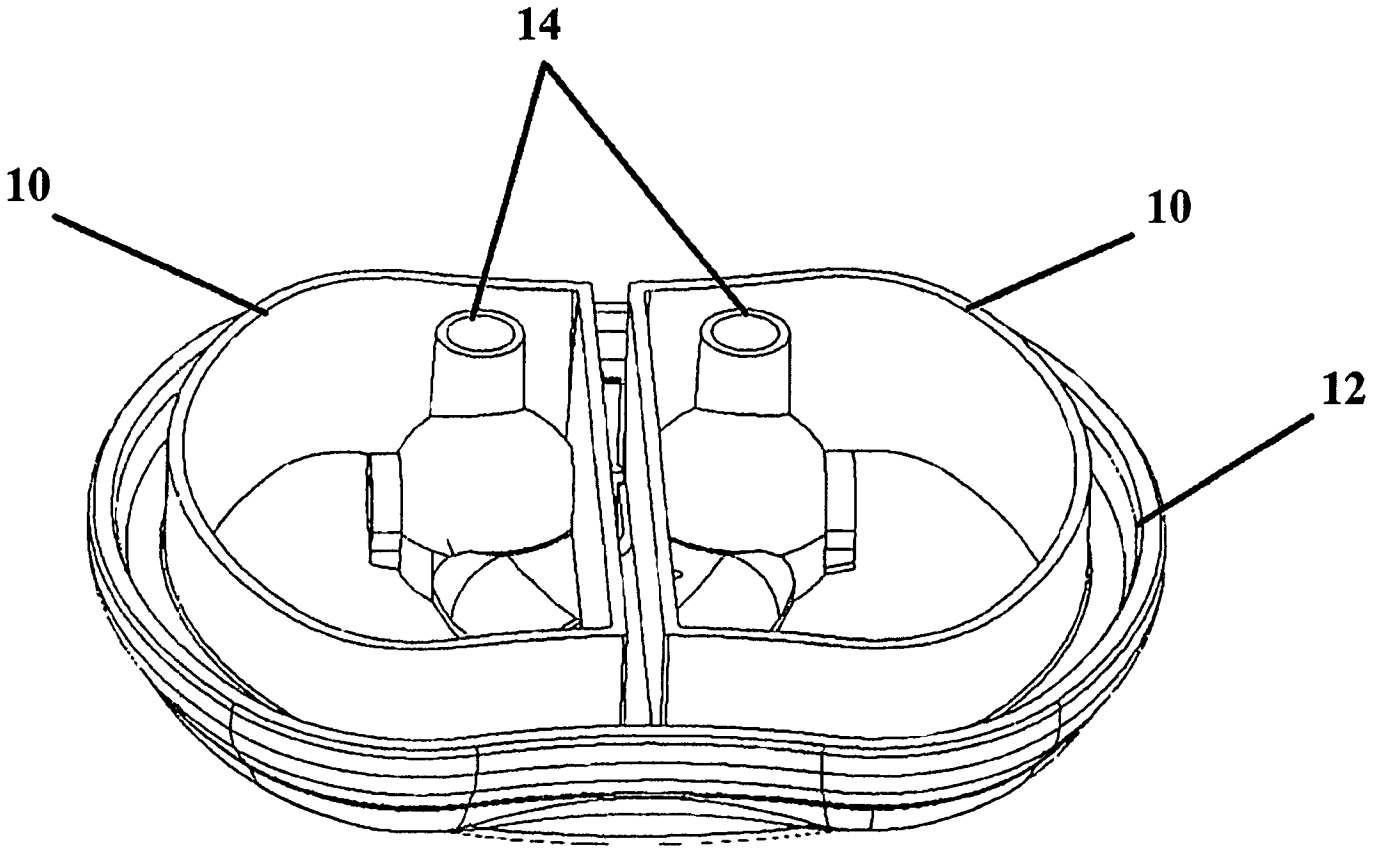
FIG. 11 Inside View

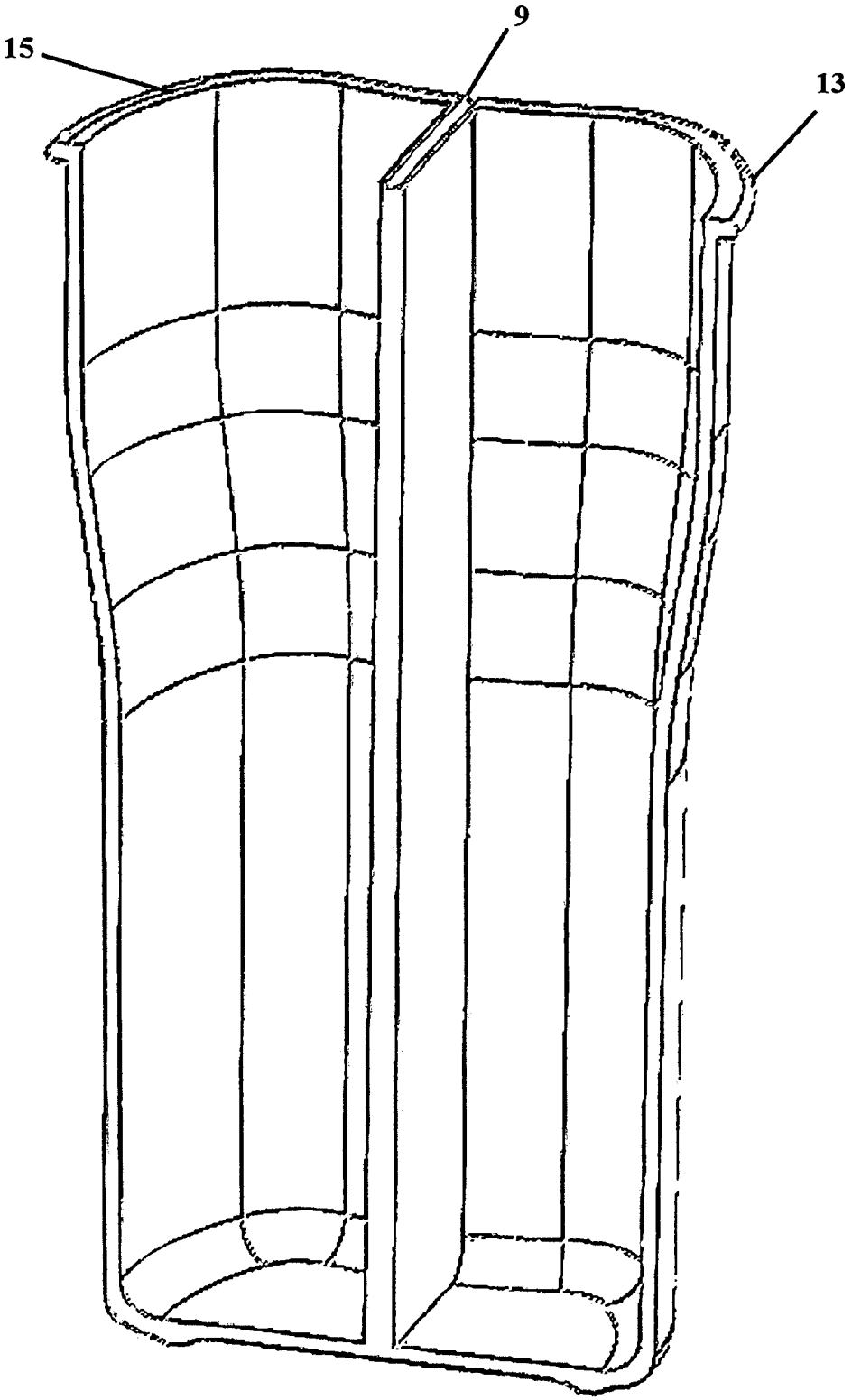
FIG. 12 Inside View

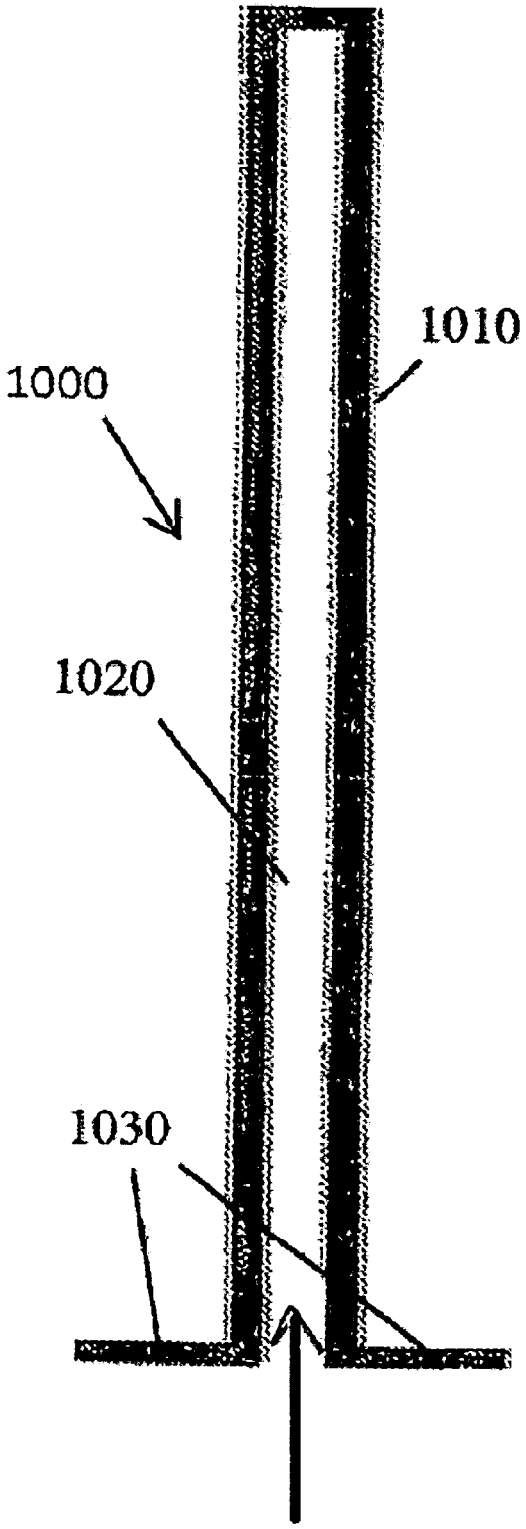
FIG. 14 Insert Clip

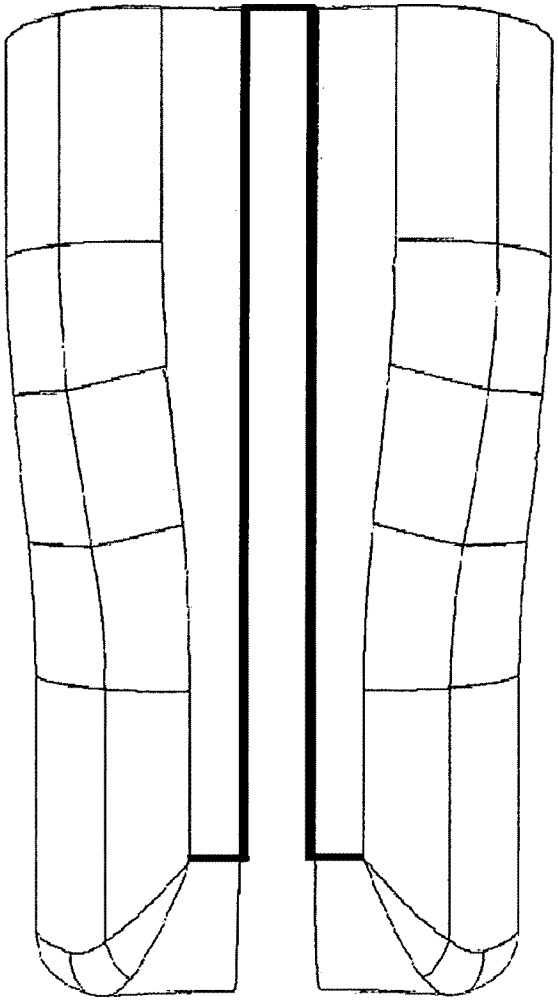
FIG. 16 U Shaped Insert

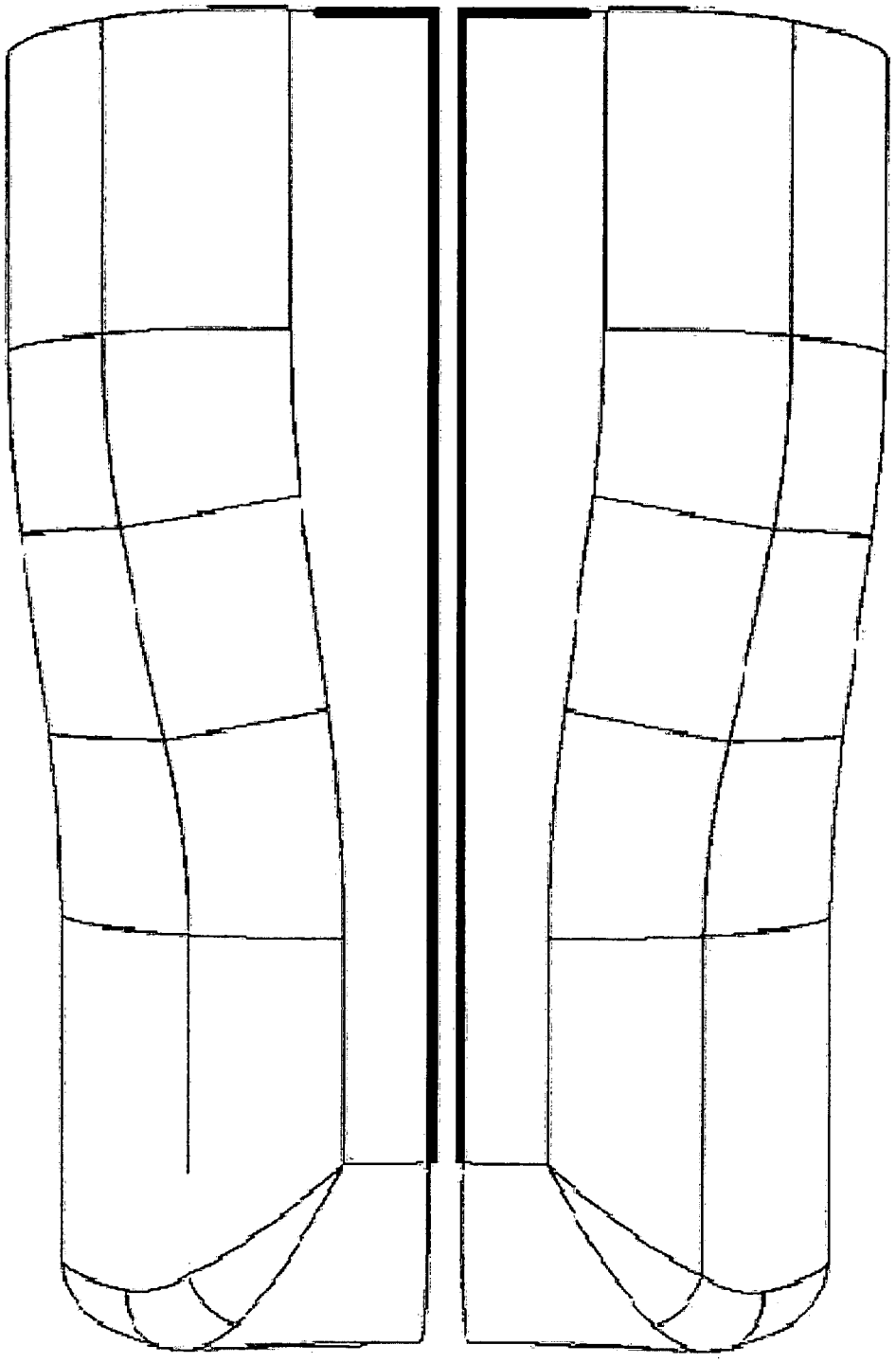
FIG. 17 L Shape Inserts

DUAL CHAMBERED CANTEEN WITH INTERCHANGEABLE LIDS

CROSS REFERENCE TO RELATED APPLICATION

This application is a continuation in part of application Ser. No. 15/064,822 filed on Mar. 9, 2016 which is a continuation in part of Ser. No. 14/296,355 filed on Jun. 30, 2014 by the present inventor which is incorporated herewith by reference.

BACKGROUND OF THE INVENTION

1. Field of Technical Art

The present disclosure relates to dual chambered containers for liquids, purees, solids where the two chambers are separated by a dividing wall and for separately dispensing liquids.

2. Description of Related Art

Liquid storage containers have been provided in numerous shapes and sizes for various liquid commodities. The most ubiquitous liquid storage containers are presently plastic and provide multiple shapes and sizes with mass production capability and recyclable materials. A popular liquid storage container is a drinking bottle. Typically, most individuals utilize a drinking bottle formed of a molded plastic material. The most common type of molded plastic drinking bottle employs a neck portion supporting a removable cap and a chamber connected to a neck portion. These plastic drinking bottles are reasonably durable, are reusable with most liquid drinks of choice, are economical to make and to purchase, and are easy to use (in that an individual can grip the bottle with one hand and take a drink via the outlet means with out spilling the liquid).

In particular, sports bottles have become very popular over the years as molded drinking bottles. Sports bottles are containers which generally have a removable lid, are relatively tall and easy to hold and have a cap or lid positioned at the top portion of the sports bottle. Sports bottles have become quite popular given the increased exercise activity of individuals. Sports bottles are convenient because they do not leak and can be readily carried or placed without fear of spilling the liquid contained therein. To use a sports bottle, one simply places the desired liquid in the sport bottle and closes the lid and/or inserts a straw. Thereafter, whenever it is desired to acquire liquid, one merely opens the lid to allow access to the liquids. Many individuals who exercise are interested in workouts of extended durations, at various levels of intensity. Thus, many individuals have available or even carry several bottles of water or other liquids to replenish body liquids lost from sweating. Thus, individuals may desire more than one type of drink to replenish the body liquids lost from sweating when engaging in one or more intense work activities, without inadvertently mixing the liquids.

Furthermore, one of the most critical needs facing individuals engaged in sports is the continuous supply or intake of different liquids (e.g., drinking water, sports drinks, energy drinks, protein shakes, etc.) while they exercise. During extended exercise activities, individuals face serious dehydration problems and the loss of competitive capabilities unless they continuously replenish the fluids lost during such exercise activities. Because of increase liquid consumption for exercise, sports etc. the need to have more than one container of water, sport drinks and other thirst quencher have also increased. Thus, there is a need to provide a bottle that is capable of dispensing more than one type of liquid separately, without inadvertently mixing the liquids Traditional sports bottles present a limitation in that they do not allow an individual to enjoy a plurality of different liquid drinks separately from each other, without the liquids mixing. Similarly there are other dual chamber bottles that have separate outlets for contents of each chamber. Most dual chamber bottles either allow the contents to reach a uniform temperature or the contents to stay at separate temperature. Thus, despite other practitioners' efforts to provide improved systems, there remains nonetheless a continuing need in the art for an improved liquid supply apparatus for use by individuals, such as, but not limited to, individuals engaged in sports or exercise activities.

U.S. Pat. No. 9,120,599 describes a very simple dual chamber drink container consisting of a lid and two straws. However, this container does not allow the user to mix contents before they leave container. The same issue arises with US Patent Application US 2013/0001233 because it does not allow mixing of contents before they leave container. U.S. Pat. No. 8,240,581 describes two outlet tubes to drink out of two containers but the apparatus described in this patent does not allow the user to have the contents mixed before they leave the apparatus. U.S. Pat. No. 6,042,018 describes liquid drinking assemblage system but does not allow liquids to be mixed before leaving the container. U.S. Pat. No. 5,794,819 provides a bottle which does not allow mixing of the contents before they leave the bottle.

US Patent Application 2015/0353260 describes a multi chamber container but does not allow mixing of the chamber contents before leaving the container. U.S. Pat. No. 5,954,213 also describes a dual chambered bottle but also does not provide for mixing of the chamber contents before leaving the bottle. U.S. Pat. No. 8,240,497 describes a dual chambered bottle but does not provide for mixing contents before leaving the bottle.

US Patent Application 2006/0021996 provides dual multi chamber drink bottle with the ability to mix the liquids before they leave. This bottle has a squeeze feature making it very difficult to refill once the contents have been emptied out. This bottle lacks the ability to actually provide users the ability to drink contents out separately. This bottle does not have the temperature control features as those presented in the present disclosure. The bottle in the present disclosure could also be used for snacks like chips, raisins etc.

U.S. Pat. No. 3,260,462 provides drinking tubes for simultaneously drinking two liquids. Compared to the present disclosure, these drinking tubes can only be use for sucking out liquids but they cannot be used for pouring out liquids. When these drinking tubes are inserted into a drinking cup with two holes, it will inadvertently lead to leakage of contents when the liquids are poured out. The present disclosure provides for gaskets between the flip up spouts which prevent the liquids from leaking out.

In US Patent Application 2015/0353259, the applicant described a dual chambered bottle with the interchangeable lids to allow a user to pour or sip the contents of the bottle separately or together by having them mixed before they are poured out.

The present disclosure is intended to overcome the drawbacks of conventional and or traditional dual chamber bottle systems by providing a means to use a single bottle with interchangeable lids to consume contents either separately or mixed together. Similarly, the present disclosure allows one dual chamber bottle to have the flexibility of either keeping contents at separate temperatures or allow them to attain a uniform temperature through optional stainless steel inserts or stainless steel clips. The gaskets between the lid and bottle body keeps the contents air tight and provides a longer shelf life. The canteen design allows. The gasket between the flip up spouts and the lid prevents leakage of contents even when the bottle is tilted upside down.

SUMMARY OF THE INVENTION

The present disclosure pertains to a multipurpose improved dual chambered container. The dual chambers can be used for storing different contents. The two chambers have a space between them. This space acts as an air barrier and prevents heat transfer between the two chambers allow them to remain at their own temperatures. So the bottle could be used for carrying both hot and cold contents at the same time. The bottle comes with three interchangeable lids. The first lid type allows the user to pour or sip out the contents of each chamber separately. When using the second lid type, the contents are mixed together before coming out of the flip up spout. The third lid type allows a snack and drink configuration where the user can drink out of one chamber and access chips and larger contents from the other chamber. There is a gasket between the lid and the bottle body to keep moisture and humidity out and provide a tight seal.

The bottle is designed with 3 interchangeable lids. The first lid is a 2-n-1 design that has separate flip-up spouts for extracting liquids from both the first and second chamber. The second lid, a 2-to-1 flip-up spout design that has two spouts for extracting contents from both the first and second chamber and merge into one spout allowing contents to mix together upon consumption. The third lid consists of a Snack and drink lid which consists of one flip up spout for sipping or pouring liquid from on chamber and a snap on lid for eating snacks, chips and other foods from the second chamber.

The dual chamber bottles comes with optional straw inserts so that user can use the bottle for both sipping and pouring. The spouts are wide enough to allow free flowing liquids, viscous liquids like apple sauce and puree, and solids like baby powder. There is an optional stainless steel insert that could be inserted in the space between the two chambers to provide an indirect physical contact for heat transfer between the contents of the two chambers. This allows the contents to reach a uniform temperature. As an additional option, an optional stainless steel clip can be inserted such as to provide direct physical contact between the contents of the two chambers. This allows the contents to reach a uniform temperature even more quickly.

Initially referring to FIG. 1-5 where like numerals indicate like and corresponding elements, a dual-chambered beverage container 1 includes the container 3 and three interchangeable lids. Container 3 is a sleek canteen shape design that has a broad shoulder contour at the top with a slight narrowing contour toward the base and a circular slightly raised stand in the center underneath the container for assisting with the leveling of the container on flat surfaces, with two compartments 5, 7 (FIG. 4) divided by a vertical partition 9. The vertical partition 9 is irremovably coupled to the container and the same height as the container's rim 13. A gasket 15 is molded around the top perimeter of the container's rim and along perimeter rim of the vertical partition. Each interchangeable lid will snap tightly and securely with a low undercut and sealed thereto by virtual of an inverted J shaped 12 peripheral section around the edge of the lid for latching and holding the lid in place.

A first lid member includes a Y-spout with the dual end 20 that attaches to a non-removable base 21 by pivotal balls 23 with axles 22 on each side of the balls. The balls 23 have an aperture 24 located on the back of each ball 23 and two aperture 25 constructed on the inside of the elongated tube spout for liquid or puree foods extraction from the single end of the elongated tube spout 26. The balls 23 are positioned over the O-rings 27 and the first opening 28 and second opening 29 of the lid base opening and first compartment 5 and the second compartment 7. Two non-removable inner wall compartments 10 are located underneath the lid and fit inside each container chamber 5, 7 to ensure lid positioning and aid in product separation. Straw attachment outlets 14

A second lid member includes Individual Spouts 30 with pivotal balls 23 with axles 22 on the sides of the ball that attaches to the non-removable base 21. The balls have an aperture 24 located on the back of each ball 23 and have two aperture 25 located inside of the elongated tube spout 20 for liquid or puree foods extraction from the single end of the elongated tube spout 26. The balls 23 are positioned over the O-rings 27 and the first opening 28 and the second opening 29 of the lid base opening and first compartment 5 and second compartment 7. Two non-removable inner wall compartments 10 are located underneath the lid and fit inside each container chamber 5, 7 to ensure lid positioning and aid in product separation. Straw attachment outlets 14

A third lid member includes an individual spout 30 with a pivotal ball 23 with axles 22 on the sides of the ball that attaches to a non-removable base 21. The pivotal ball have an aperture 24 located on the back of the ball 23 and have two aperture 25 located inside the elongated tube spout 20 for liquids and puree foods extraction from the single end of the tube spout 26 on the top of one side of the lid. The pivotal balls 23 are positioned over the O-rings 27 and the first opening 28 and the second opening 29 of the lid base opening and first compartment 5 and second compartment 7. Straw attachment outlets 14

The other side on the top of the lid has a hinge snap lid 31 with a slightly raised snap design 32 for opening and closing the lid hinge door. The hinge door has a gasket 15 molded into the rim perimeter of the snap closure for a secure and airtight seal. Two separate non-removable inner wall compartments 10 are located underneath the lid and fit inside each container chamber 5, 7 to ensure lid positioning and aid in product separation. An atmosphere release vent holes 33 and release hole plugs 34 are designed for liquid flow when flip-up spouts are in use and secure an airtight secure seal when in the closed position.

Though it is intended to fully describe the invention as set forth, it is also reasonable to assume that one skilled in the art could modify, adjust or adapt certain parts of this dual-chambered beverage container without departing from its original scope. The implementation of an individual or even a combined improvement as part of another dual-chambered beverage container is possible. For example, adding more compartments would be well within the bounds of what has been presented here. Other configurations such as a vertical partition, insulated materials for more or less thermal conductivity between compartments or the container. Various known configurations could be used to partition two or more liquids or puree foods with a single container or other features could be added to the lid opening. The defining features of this improved dual-chambered beverage container is that in addition to easily positioning and sealing the secured and airtight lid, the configuration is such that the opening to spouts and each chamber will be consistently positioned in a fixed configuration whether in the open or closed position and the to provide a dual separation to single mixing experience.

The recommended materials are but not limited to plastic, stainless steel, foam and glass. Other modifications will readily suggest themselves to others of ordinary skills in the art without departing in any way from the spirit of the present invention. The invention is merely intended to embrace all such alternatives and modifications or configurations as fall within the broad scope of the appended claims.

The present disclosure is intended to overcome the drawbacks of conventional and or traditional dual chamber bottles and container systems by providing a means to use a single bottle with interchangeable lids to consume contents either separately or mixed together without the possibility of leakage. Similarly, the present disclosure allows one dual chamber bottle to have the flexibility of either keeping contents at separate temperatures or allow them to attain a uniform temperature through optional stainless steel inserts or stainless steel clips. The gaskets between the lid and bottle body keeps the contents air tight and provides a longer shelf life. The canteen design allows. The gasket between the flip up spouts and the lid prevents leakage of contents even when the bottle is tilted upside down.

DESCRIPTION OF DRAWING

The invention with features, advantages and additional parts will apparent and best understood from the following detailed description in conjunction with the drawings in which:

FIG. 6 is a top view of the lid without the spout and shows the O-rings positioned around the opening of the non-removable lid base.

FIG. 7 is a view of the non-removal inner walls located underneath the lid for lid positioning and product separation of the chambers.

FIG. 8 is a side view of the low undercut inverted J shaped peripheral section around the edge of the lid for latching and locking the lid in a secure airtight position.

FIG. 9 is the view of the aperture located on the back of the pivotal balls.

FIG. 10 is the inside view of the aperture on the inside of the elongated tube spouts.

FIG. 11 is the inside view of the lid showing short elongated tubes outlets for adding straws which is optional. The straws would work in co-conjunction with the spouts for product extraction.

FIG. 12 is the inside container view of vertical partition from top to bottom of the container. The container has a rectangular open space that provides a partition as well.

FIG. 1A is a perspective top and front view of the body of the bottle having two chambers of equal size. The slot for the insertion of a gasket around the top of the bottle body can be seen in this figure. 100 refers to the bottle body. 104 refers to the round bottom feature of the bottle body. 500 refers to the gasket. The bottle body essentially comprises of two chambers with each chamber having a curved wall on one side and a straight wall on the other side. 109 refers to small wall that connects the curved wall of both chambers. 111 refers to the rectangular space between the walls of the two chambers. There is a hollow space in the central wall such that the walls of each chamber do not come in contact with each other.

FIG. 3A is a perspective view of the circular bottle bottom for placing the bottle stable and upright.

FIG. 14 is a perspective view of the stainless steel clip sleeve. 1000 refers to this clip which slides over the central wall such that the stainless steel portion comes in contact with the inner walls of each chamber. This clip sleeve allows direct thermal contact between the contents of the two chambers allowing the contents to reach a uniform temperature much faster than without the insert.

FIG. 16 illustrates the L shape insert mounted on the canteen container.

FIG. 17 illustrates the U shape insert mounted on the canteen container.

DETAILED DESCRIPTION OF INVENTION

Figure 1:
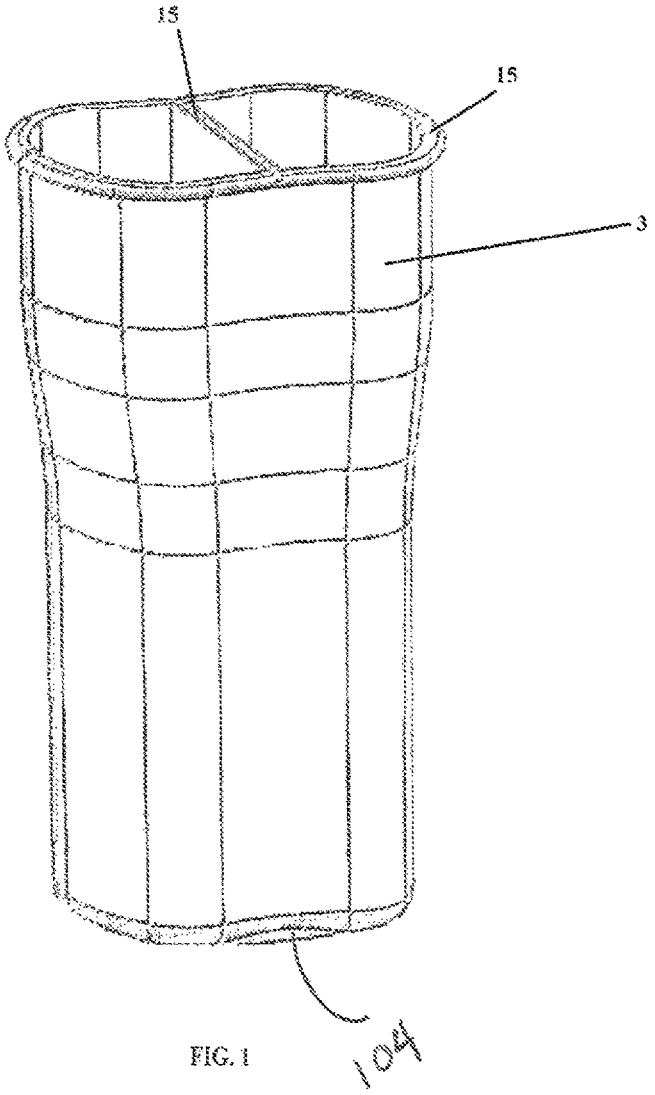
FIG. 1 is a perspective view of the dual chambered beverage container constructed in accordance with the invention.
Figure 2:
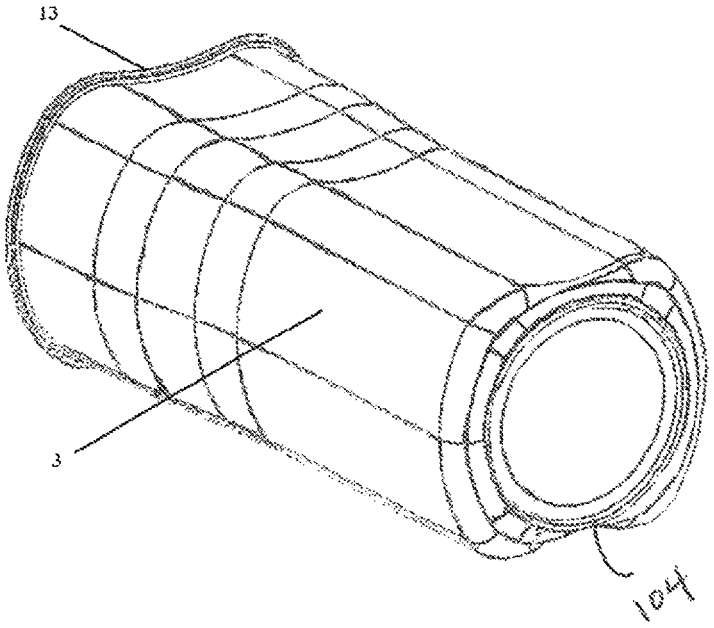
FIG. 2 is a bottom view of the dual chambered beverage container showing the sleek canteen design and the peripheral section around the edge of the rim for latching and holding the lid in place.
Figure 3:
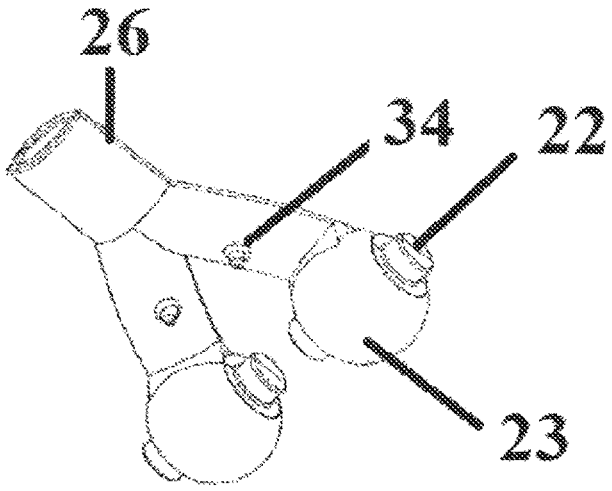
FIG. 3 is a bottom view of the Y-spout with the pivotal balls and axles attached to the non-removable lid base in the closed position.
Figure 4:
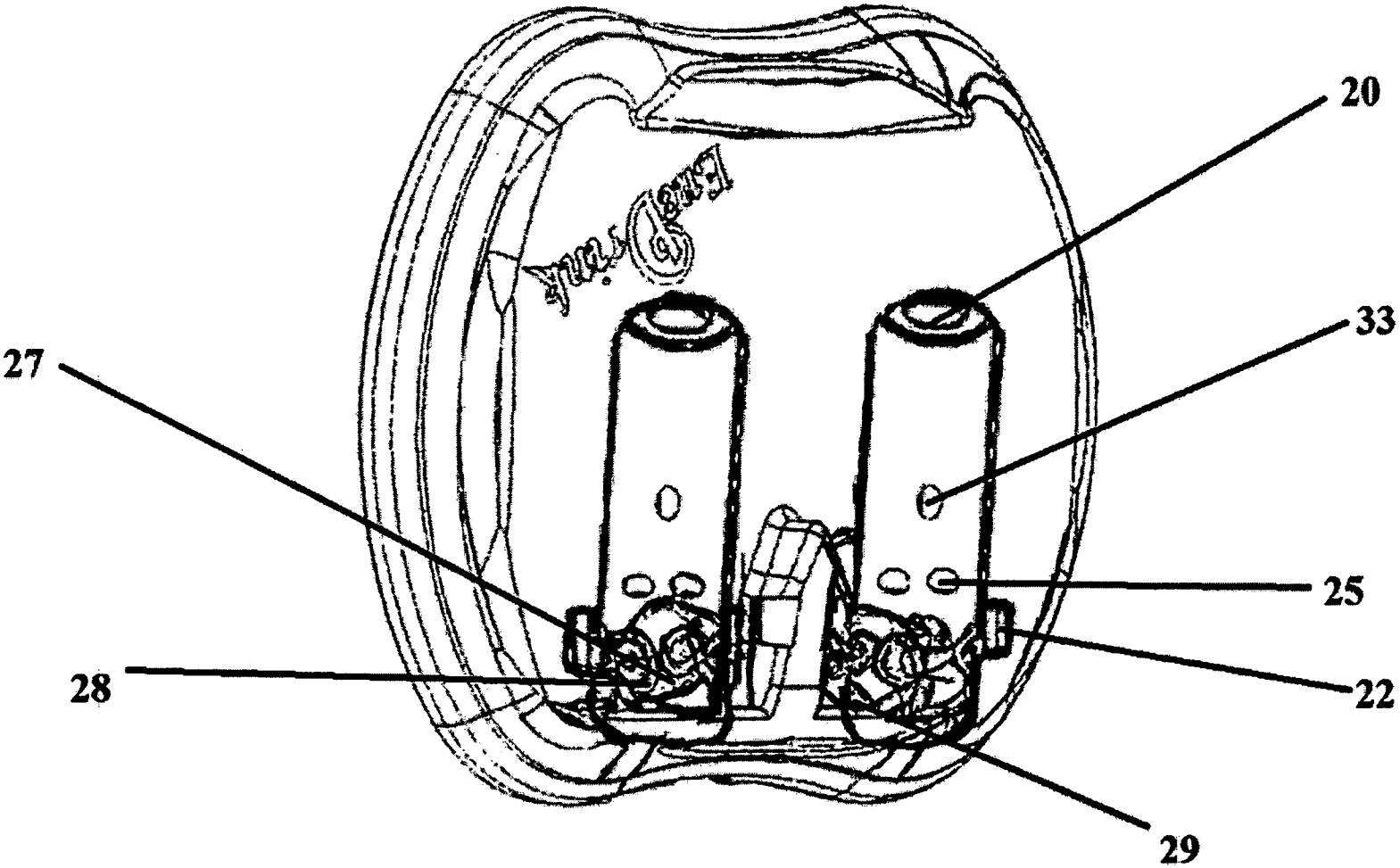
FIG. 4 is the top view of the individual spouts with the pivotal balls and axles attached to the non-removal lid base in the closed position.
Figure 5:
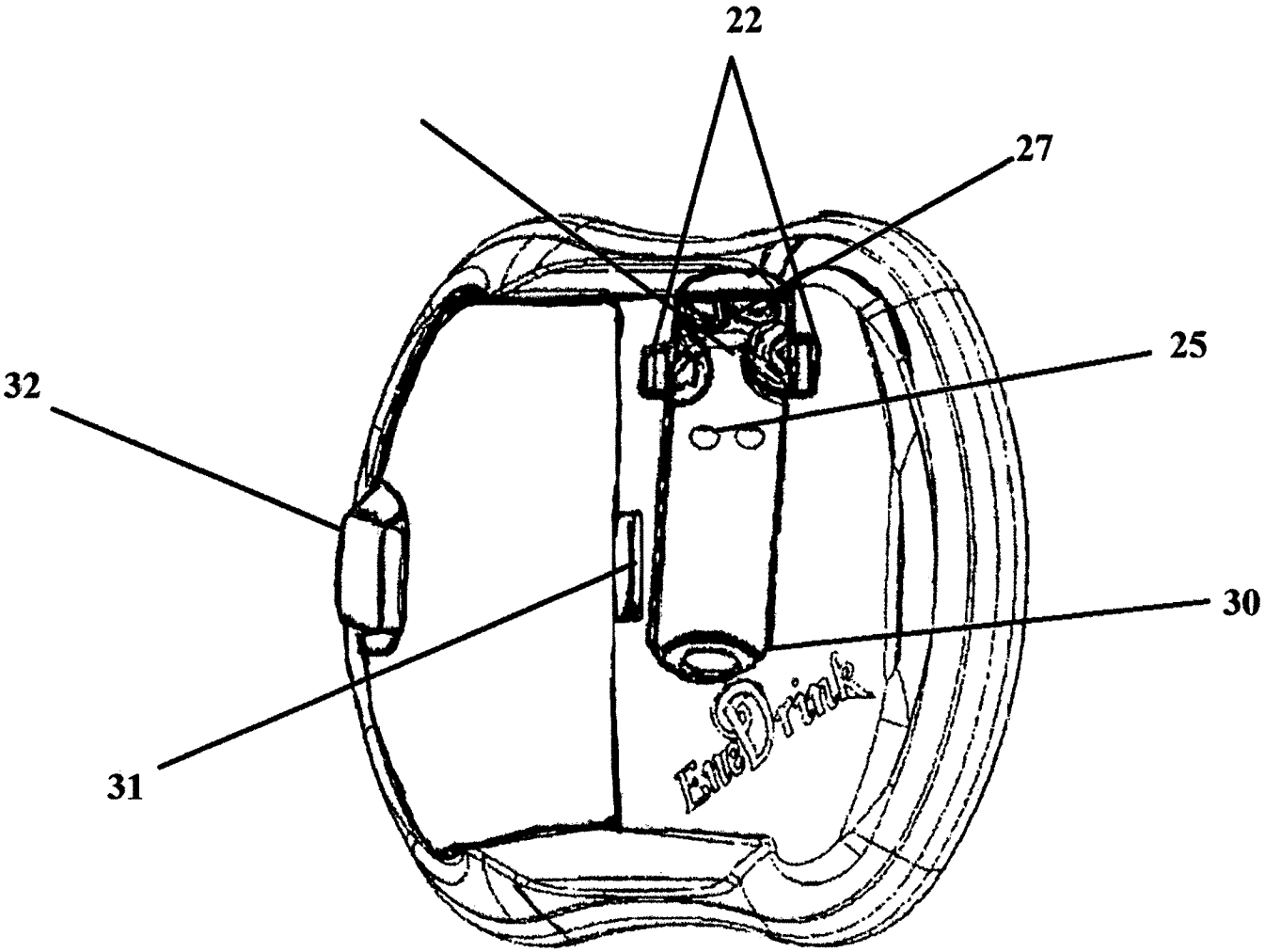
FIG. 5 is the top view of the snack and drink spout with the pivotal ball and axles attached to the non-removable base in the closed position and hinge side snap with the raised lip construction for opening and closing the snack snap lid in the closed position.
Figure 5A:
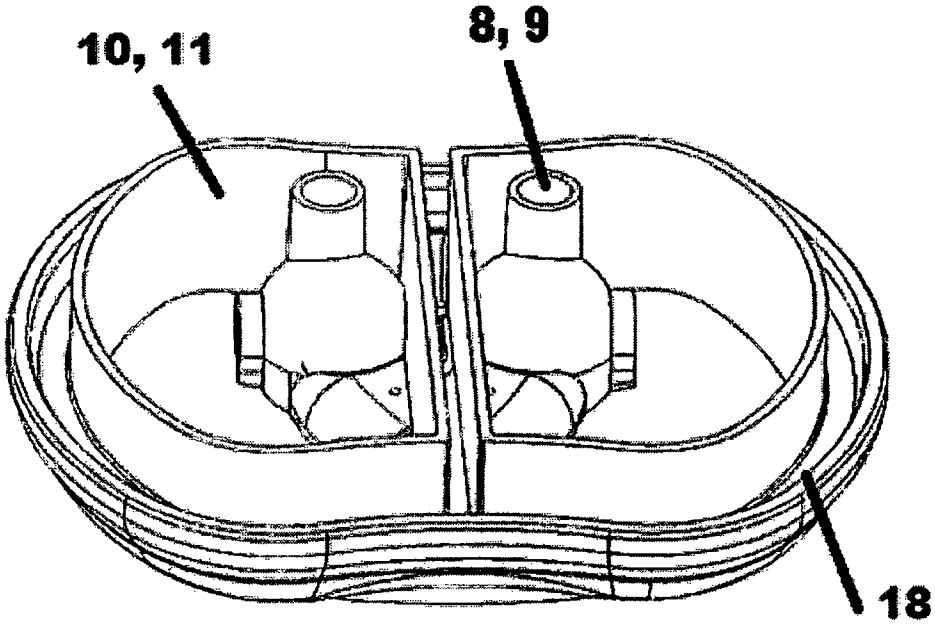
FIG. 5A is a perspective view of cutaway bottom view of the lid.
Figure 6A:
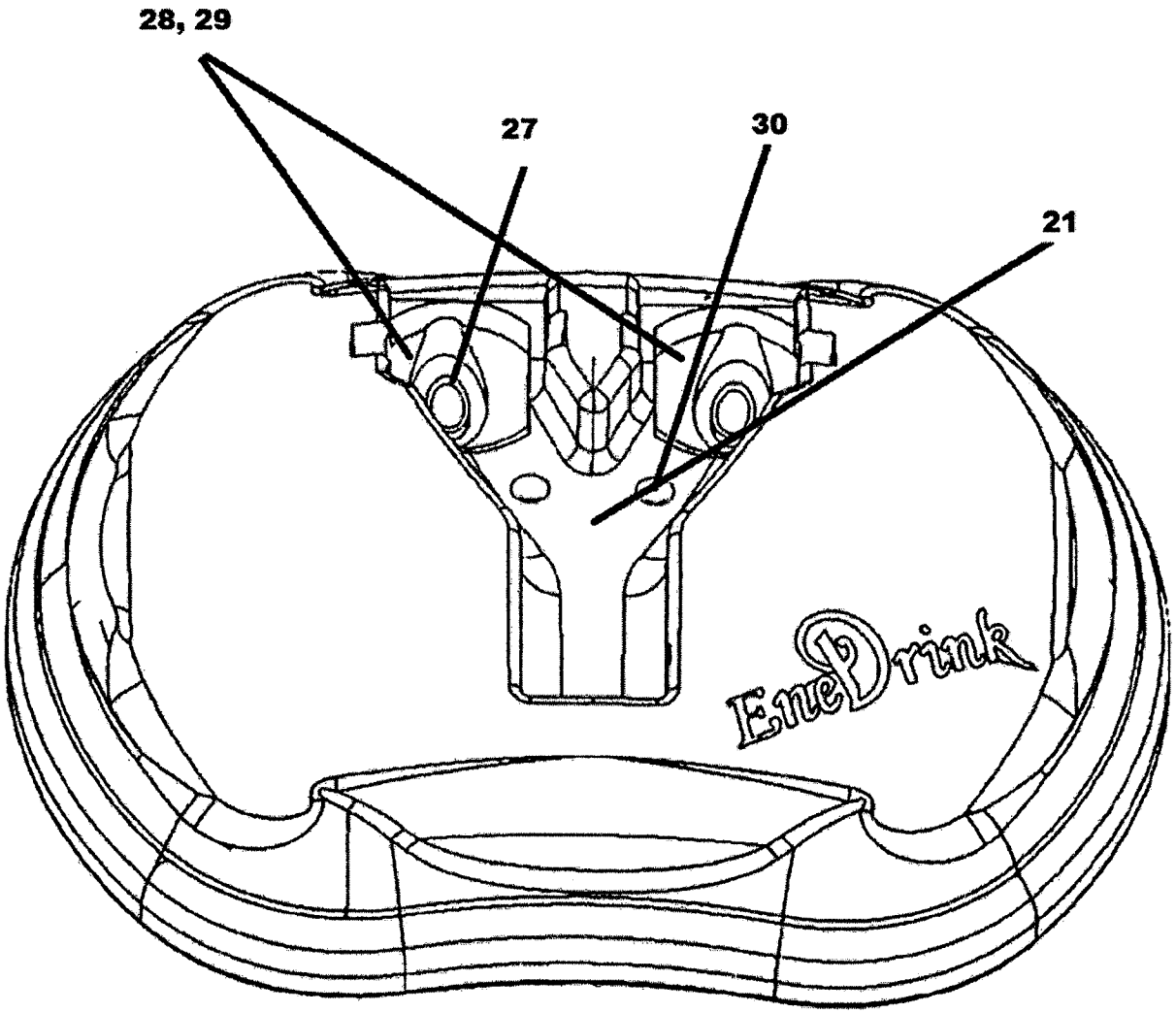
FIG. 6A is a perspective view of cutaway top view of the lid.
Figure 7A:
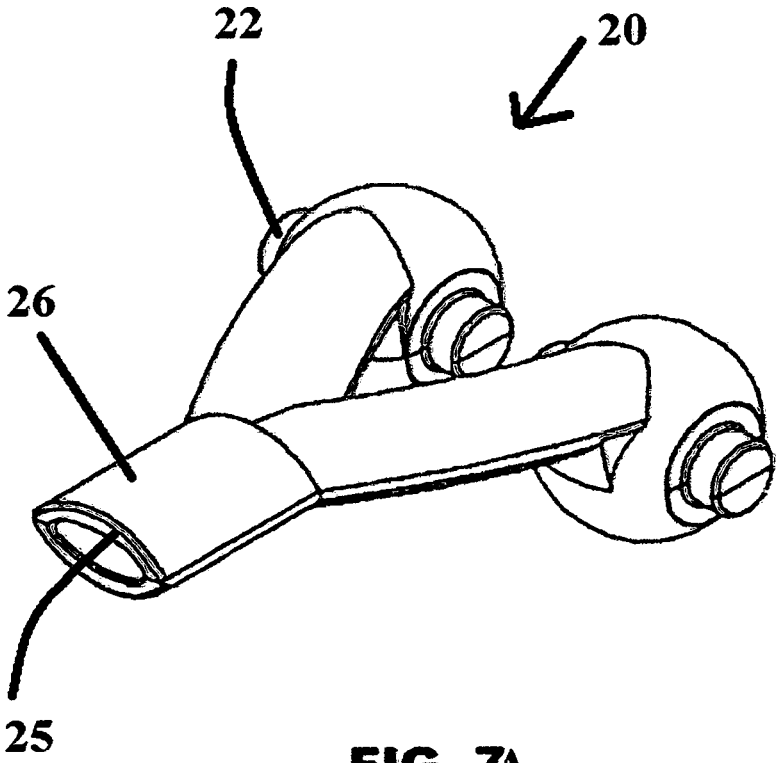
FIG. 7A is a perspective view of cutaway top view of the Y-Spout.
Figure 7B:
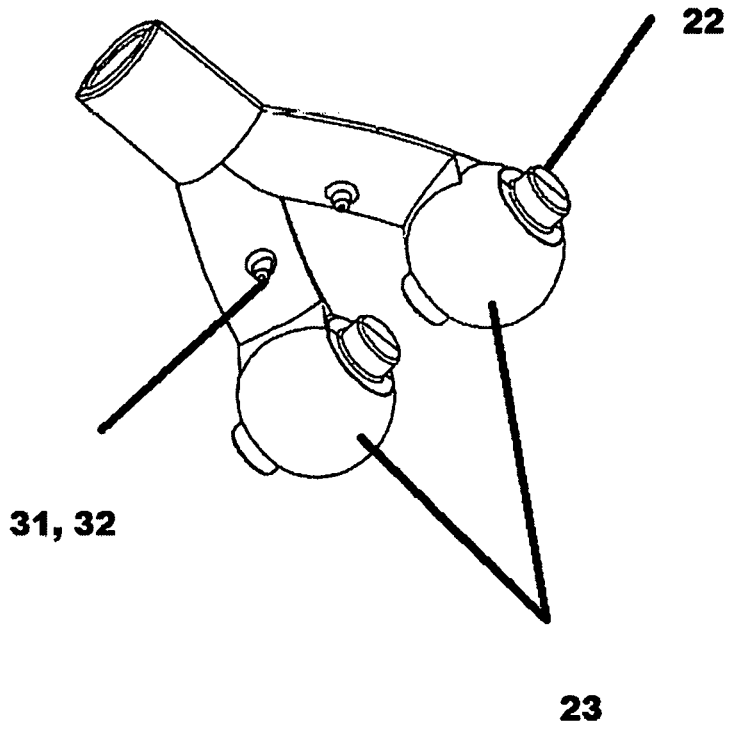
FIG. 7B is a perspective view of cutaway bottom view of the Y-Spout.
Figure 8A:
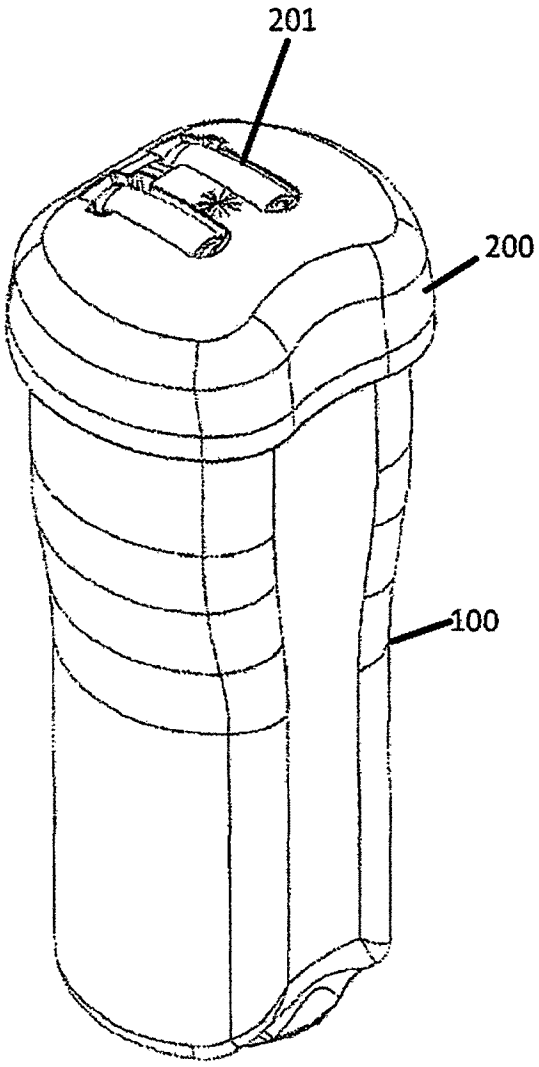
FIGS. 8A, 8B, 8C are is a perspective views of the bottle with 2-n-1 lid. 2-n-1 lid consists of two flip up spouts. The contents of each chamber flows separately out of the spout. 201 refers to 2n-1 flip spout.
Figure 8B:
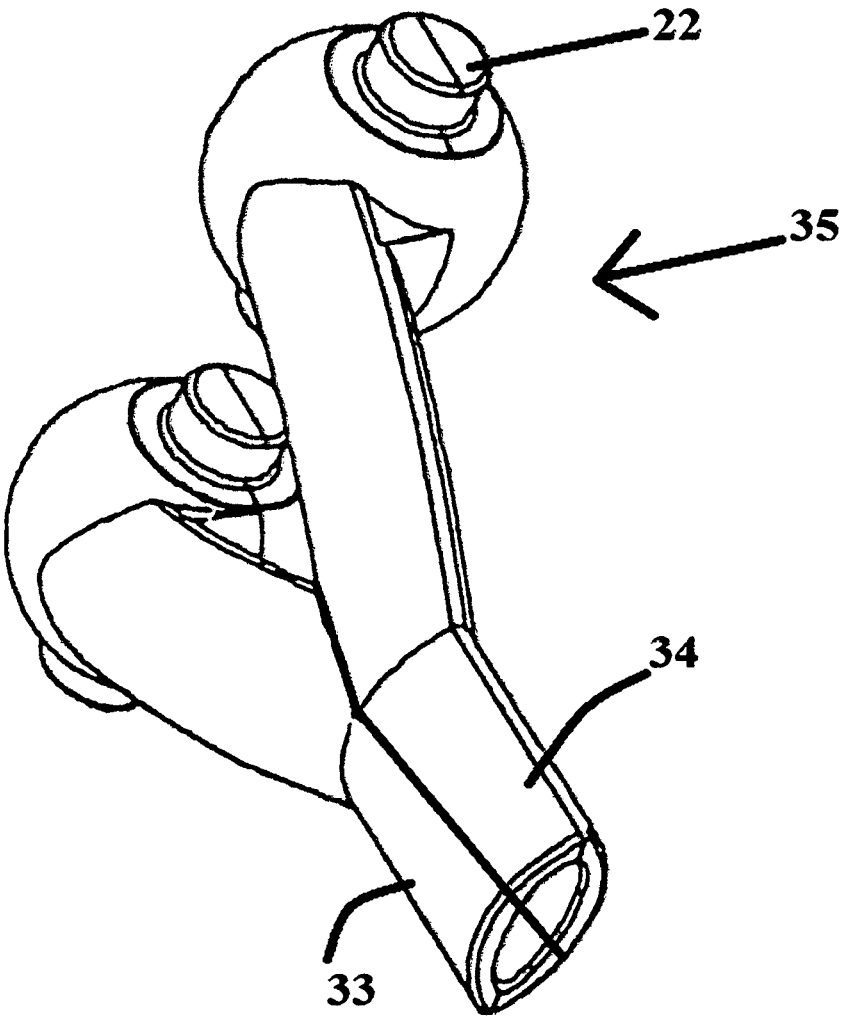
Figure 8C:
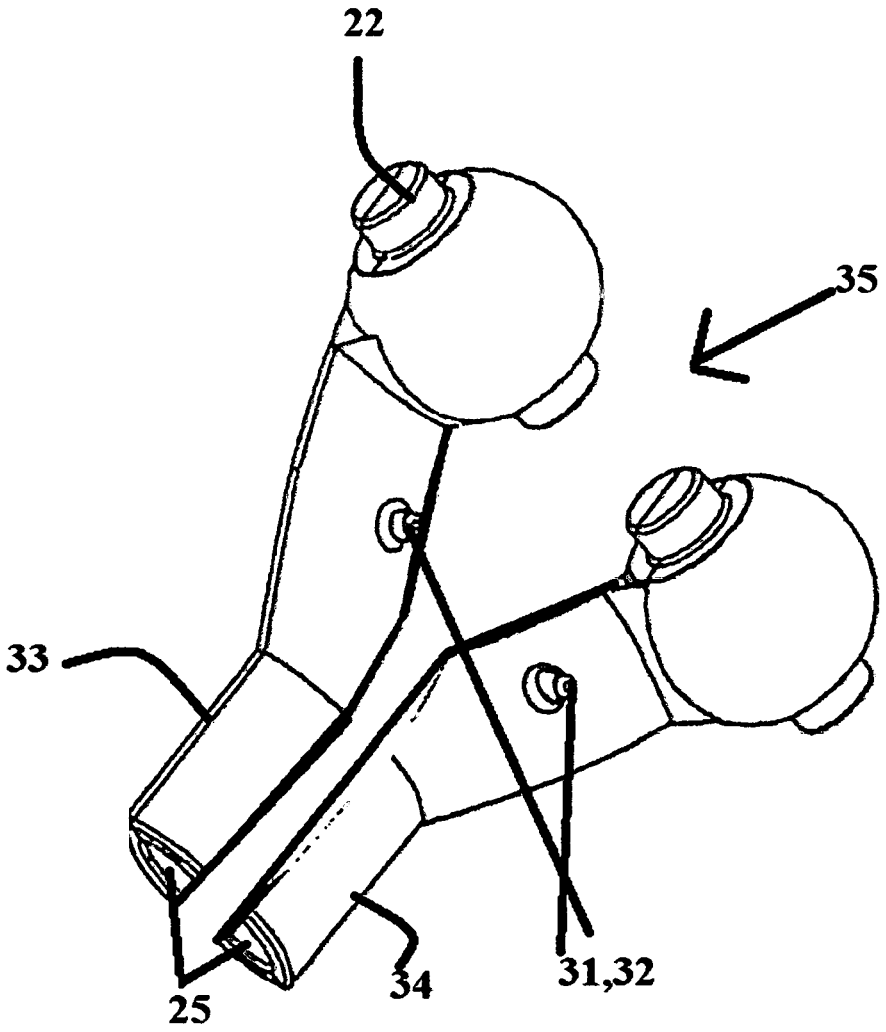
Figure 9A:
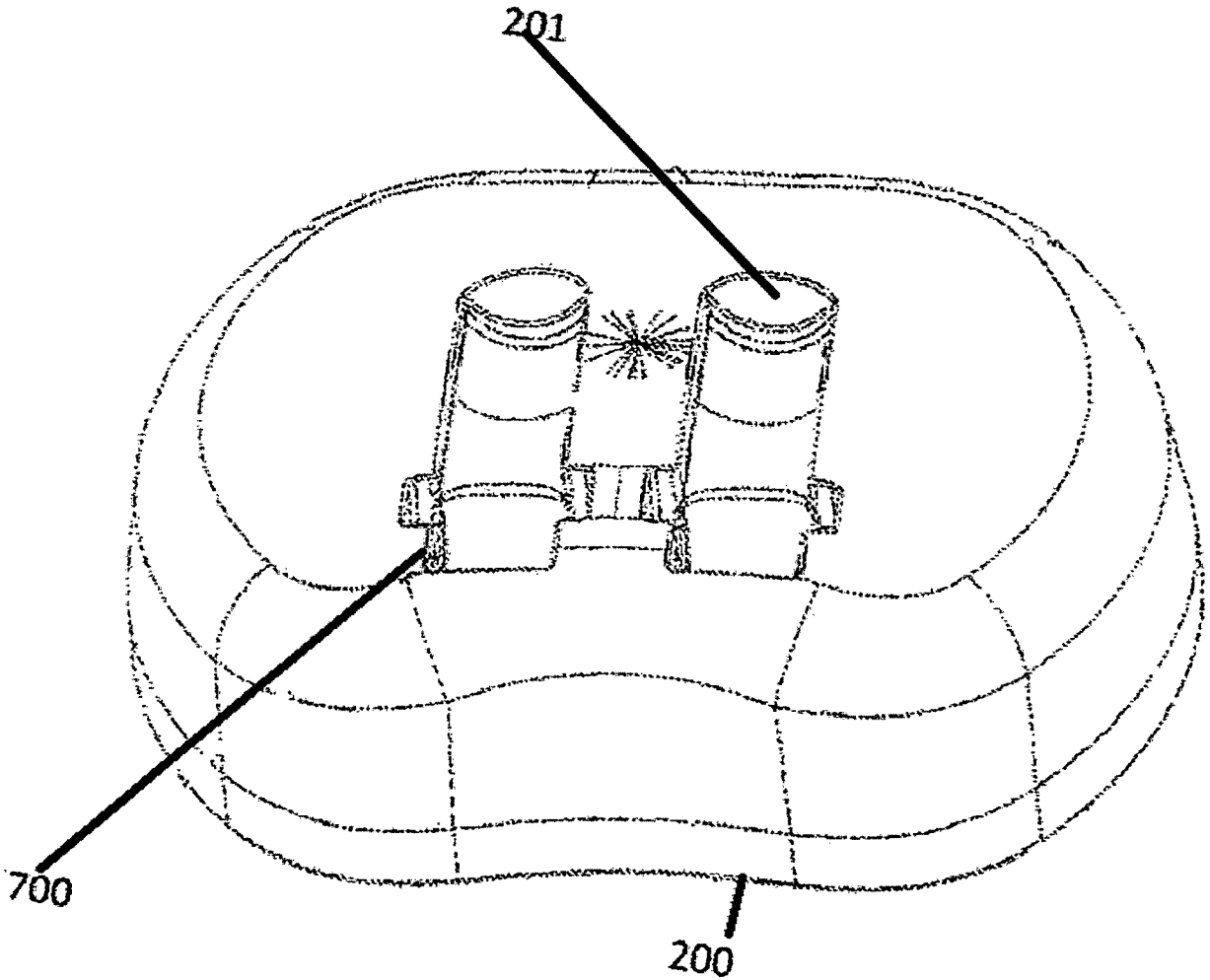
FIG. 9A is a perspective view of the 2-n-1 lid. 700 refers to gasket for flip up spout closure of 2-n-1, 2-to-1 and snack and drink lids. This gasket prevents leakage when the bottle is turned upside down and ensures a tight seal from external elements.
Figure 10A:
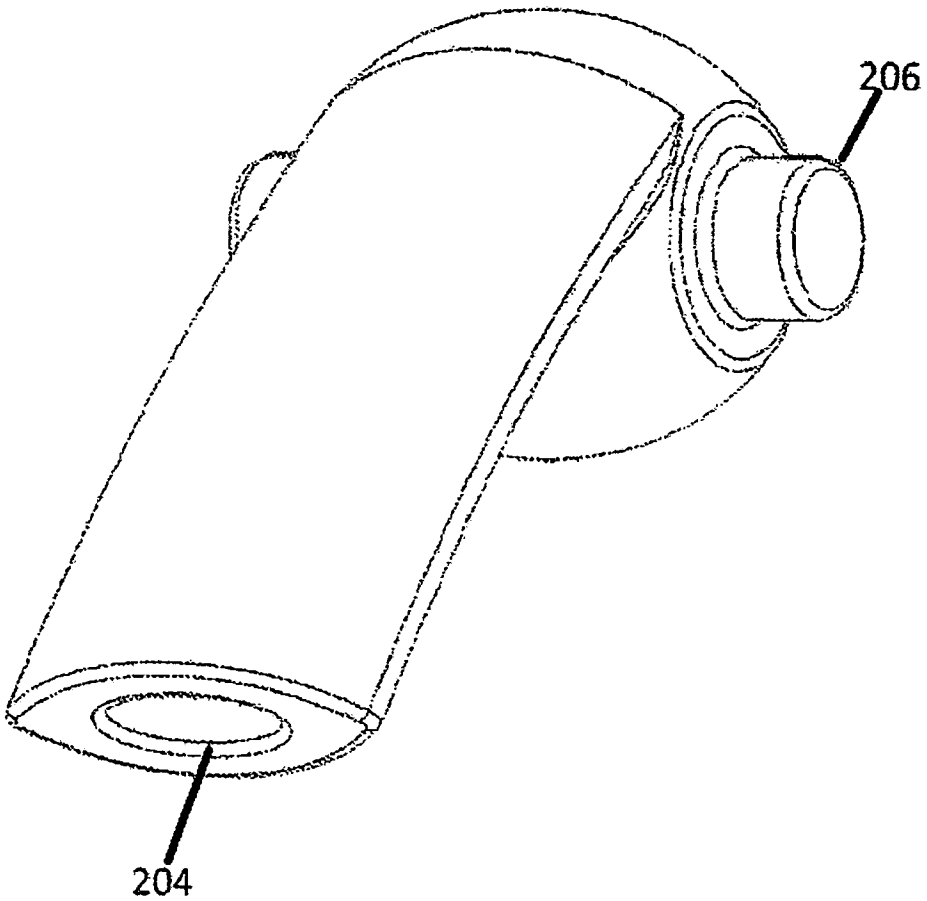
FIG. 10A is a perspective view of the 2-n-1 spout. 206 is arm for locking spouts in place atop lid. 204 refers to the front aperture.
Figure 12A:
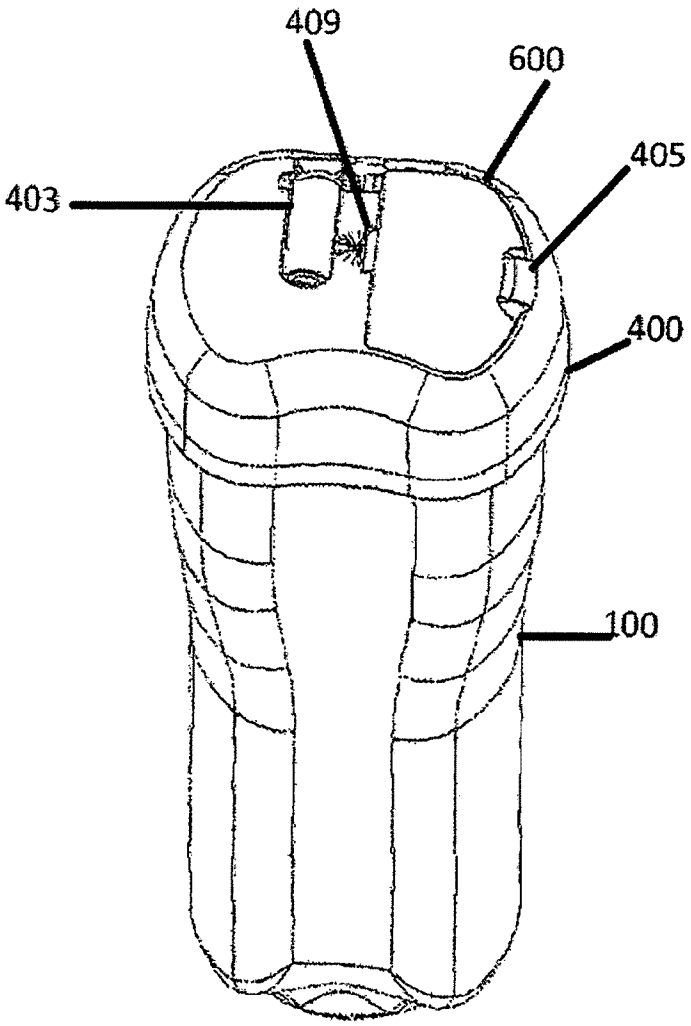
FIG. 12A is a perspective view of the bottle with a snack and drink lid. The snack and drink lid consists of a flip up spout as shown in FIG. 9 and a large D' shaped snap lock flap. The D' shaped snap lock flap is large enough for contents like chips and others to be poured out through them. 400 refers to the snack and drink lid. 403 refers to the flip up spout on the snack and drink lid. 405 refers to the where the snap lock flap. 409 refers to where the snap lock flap is connected to the snack and drink lid. 600 refers to the gasket on the snap lock flap closure and is used to maintain freshness and prevent leakage when the bottle is turned upside down.
Figure 13B:
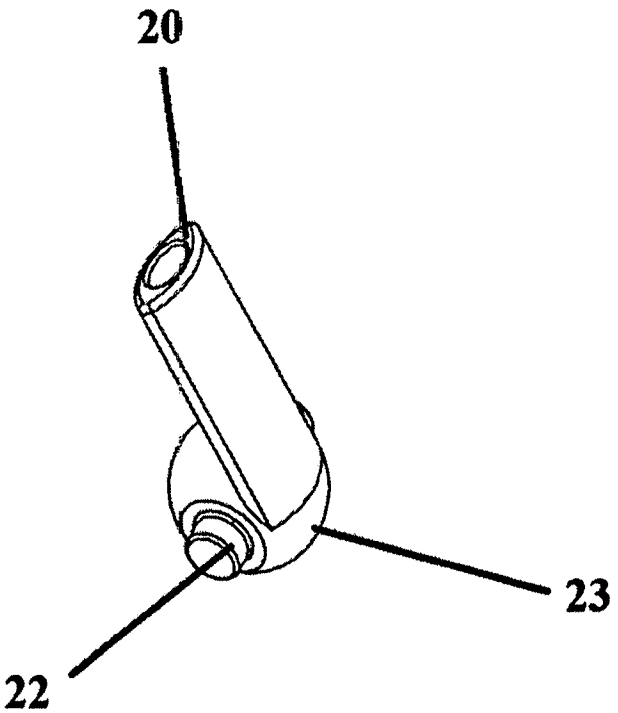
FIGS. 13*a* and 13*b* is an exploded view of the spout and hinge snap lid.
Figure 13A:
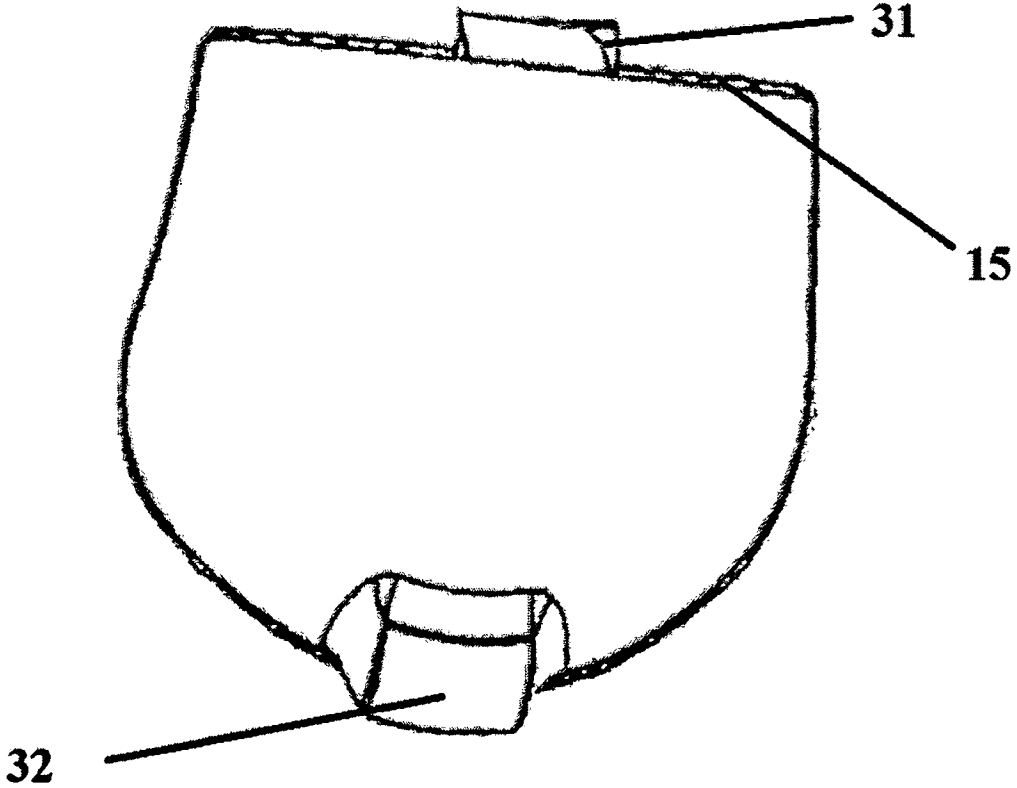
Figure 13C:
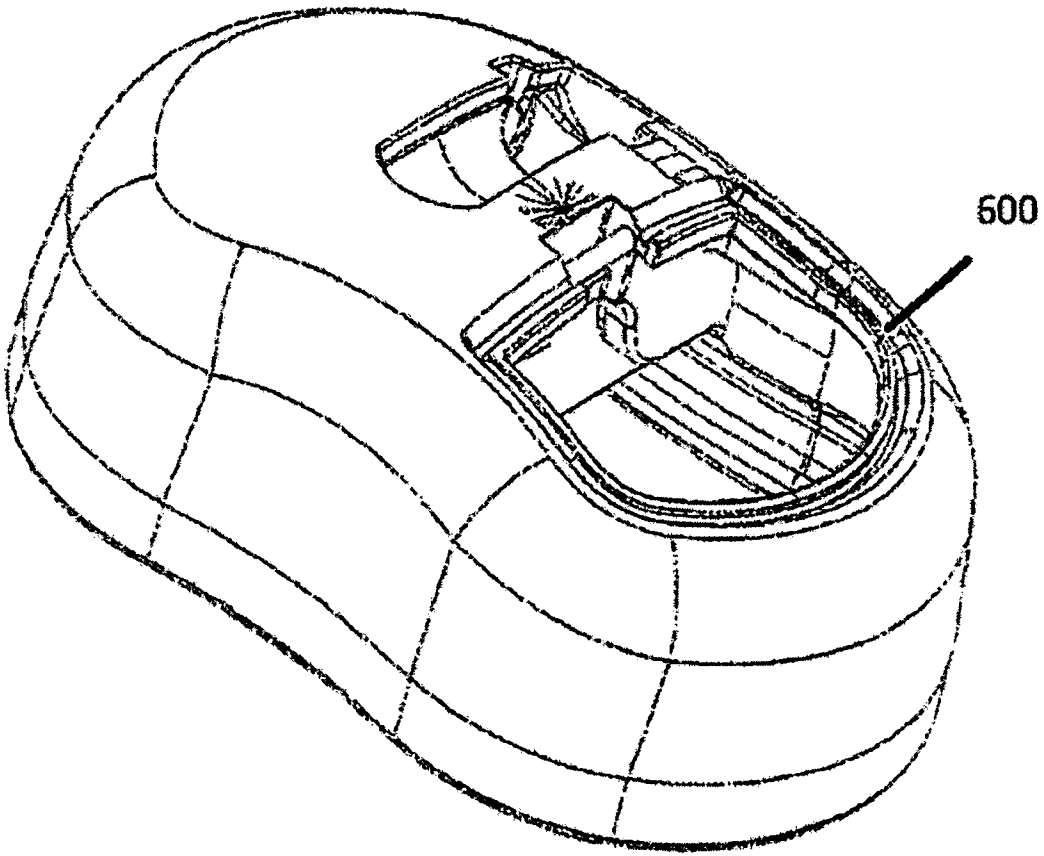
FIG. 13C is a perspective view of the snack and drink lid.
Figure 15B:
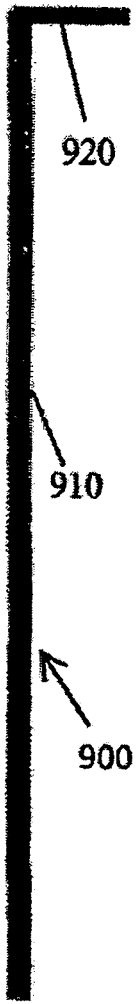
FIGS. 15*a* and 15*b* are perspective views of the stainless steel clip insert that can be inserted into the space between the inner central walls of the two chambers. 900 refers to this insert. The insert can slide in and out of this space. When the stainless steel insert slides between the walls of the two chambers, it creates direct physical contact between the contents of the two chambers. However because heat has to transfer through three walls, the heat transfer does not occur very quickly. Hence, the contents of the two chambers will reach a uniform temperature but slower than when the clip sleeve is used.
Figure 15A:
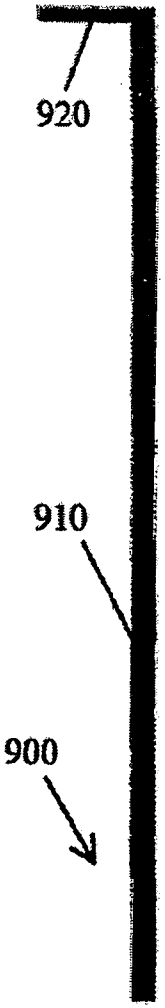

The following description of the preferred embodiment is merely exemplary in and is in no way intended to limit the invention in its application or use. The description of illustrative embodiments according to principles of the present invention is intended to be read in connection with the accompanying drawings which are to be considered part of the entire written description. Any reference to direction or orientation is merely intended for convenience of description and is not intended in any way to limit the scope of the present invention. The present disclosure describes an improved dual chambered container which will have the following features and functionality. There are two embodiments one with a solid partition and one with a rectangular space.

Dual chambered container consisting of: the bottle body 100 with the two hollow chambers three different types of lids 200, 300, 400, that go on top of the bottle body; pair of stainless steel inserts 900 that can inserted between rectangular space between the bottle chambers; inverted CU' shaped steel clip sleeve 1000 that can go in each of the hollow chambers.

Two hollow chambers in the bottle body 100 designed to hold liquids, snacks, solids and purees. The two hollow chambers are essentially two separate plastic bottles that are held together by a small wall 109 on either side of the bottle body. The bottle body essentially comprises of two chambers with each chamber having a curved wall on one side and a straight wall on the other side. The curved and the straight walls run along the longitudinal length of the bottle. The straight walls of the two chambers are not fused and hence there is no common wall in the center of the bottle. Instead, they are joined together by a small wall 109 on either side of the bottle thereby forming a rectangular space 111 between the walls. The small wall 109 and the rectangular space 111 runs along the longitudinal length of the bottle body 100. This space between the hollow chambers prevents direct physical and thermal contact between the contents of the two chambers due to presence of air which acts as an insulator. This prevents them from attaining a uniform temperature.

The body of the bottle 100 can be made out of BPA free plastic, stainless steel or glass. This type of bottle will allow moisture to be kept out of the dual chambered bottle.

The shape of the entire bottle is in the form of a canteen with the middle section smaller in cross-sectional length than the outer section. Canteen shapes have been proven effective in pouring out more fluid than comparable bottles and containers.

The lid will cover the body of the bottle 100. A lip along the mouth of the lid is added for secure and tight closure and locks the lid in place. Gasket is a molded over and embedded within the outer rim of the upper perimeter of the. This gasket will be made out of silicon. It will be heat resistant with and manufactured with FDA approved food grade material.

The lids can be put on the plastic, stainless steel or glass bottle body. All lids will have the following common features:

Flip up spouts with the wide enough diameter to allow puree foods, thick and viscous liquids, or easy flowing solids of 12 micron size such as baby powder, powdered fruit drink mixtures to flow through them. There are gaskets attached at the connection point of the flip up spout to the bottle body. These gaskets allow tight seal when the flip up spout is closed to prevent leakage from the bottle when it is turned upside down. The gasket also provides a seal from the external elements. This arrangement only allows contents to be poured out only when the flip up spout is lifted up. A wall extending from the center cross-sectional line of the lid to the to the top of the bottle body thereby forming two separate chambers inside the lid. There will be three different types of interchangeable lids: 2-n-1 lid will allow individual consumption of the contents of the two chambers. The 2-n1 lid will consist of two flip up spouts each projecting into one of the chambers.

2-to-1 lid will allow the contents of the two chambers to mix together prior to reaching the mouth. There will be one flip-up spout 301 which is really two flip up spouts that fuse together to form an inverted 'Y' with two inlets and one common outlet. The common outlet will allow the contents of the two chambers to mix together before leaving the outlet aperture. The 2-to-1 feature allows the contents of the two chambers to mix together before the contents enter the mouth. Snack and drink lid have one flip up spout similar to the 2-n-1 spout that for drinking liquid from one chamber and a snap on lid for eating snacks, chips and other foods from the second chamber. Snack and drink lid have a snap lock on the inside of the lid that locks the lid in place. The snap on feature provides easy access for both liquid and sold contents. There is a gasket 600 on the snap lock flap closure that is used to maintain freshness and prevent leakage.

The bottom portion of each flip up spout will project into one of the two hollow chambers. Straws can be inserted into the bottom portion of the each flip up spout as shown in 203 and 303.Inserting the straw will allow the individual to sip on the contents. Without the straws, individuals will have to pour the contents out in their mouth.

The bottle will be made with an injection mold. 1000 is an inverted CU' shaped stainless steel clip that is the same length as the central wall of the bottle body and of same height as that of the inside of the hollow chambers. 1000 will snuggly slide over the central wall of bottle body like a sleeve.

Once the stainless steel clip sleeve is inserted over the central wall of the bottle body, it will create direct physical contact between the contents of the two chambers thus acting as heat transfer bridge allowing heat to be transferred from the contents of one chamber to the other allowing them to reach a uniform temperature very quickly. When the stainless steel clip sleeve slides in all the way to the inside bottom of the chambers, it will sit directly on top of the gasket 500. There is a space between the straight walls of the two chambers 111. Two inverted shaped stainless steel inserts could be inserted in this space 111. The vertical section will slide into the rectangular space 111 and the shorter horizontal section will sit on the top central rim of the bottle body. The gasket 500 will sit on top of the horizontal section of the stainless steel inserts. Insertion of the stainless steel inserts will allow the two chambers to attain a uniform temperature over time. When the stainless steel inserts slides between the walls of the two chambers, it creates direct physical contact between the contents of the two chambers. However because heat has to transfer across three walls, the heat transfer does not occur very quickly. Hence, the contents of the two chambers will reach a uniform temperature but slower than when the clip sleeve is used.

What is claimed is:

1. A canteen beverage container comprising:

the container having a body member with a pair of opposing dual chambers separated by a non-removable partition that extends vertically from an opened top end to a lower end;

the container being non-removable;

the lower end being seated upon a base;

a rim formed at the opened top end by the pair of opposing dual chambers;

each of the pair of opposing dual-chambers having a symmetrical shape;

each of the pair of opposing dual-chambers having a bottom wall with a surrounding wall extending linearly upward to the rim;

a lid having a peripheral edge encircled by an inverted J shaped lip for securely engaging with the rim;

a top side and an underside;

a recessed area within the top side dimensioned and shaped to receive a dual separated spout;

each spout of the dual separated spout having a hollow tubular member with a distal end having an opened end;

each spout of the dual separated spout extending to a pivot ball that is seated above a dual chamber; and on opposing sides of each pivot ball is a pivoting axle wherein each spout of the dual separated spout can pivot between an upward and a downward position.

2. The canteen beverage container of claim 1 wherein the base has a circular circumference.

3. The canteen beverage container of claim 1 wherein the base has a raised center portion thereby allowing the container to stand on flat surfaces.

4. The canteen beverage container of claim 1 wherein a first pair of release holes is attached to the underside of the lid into a second pair of corresponding release holes plug on underside of each spout thereby allowing an airtight seal when each spout is in a closed position.

5. The canteen beverage container of claim 1 wherein the lid further comprises a set of O rings circumferentially surround the underside of the peripheral edge of the lid.

6. The canteen beverage container of claim 1 wherein the lid further comprises one or more straw attachment outlet disposed above a corresponding dual chamber and extending through the lid thereby allowing fluid to flow from the corresponding dual chamber.

7. The canteen beverage container of claim 1 further comprising: a pair of atmosphere release plugs disposed underneath each separated dual spout;

a pair of corresponding atmosphere release vent holes for engaging with the pair of atmosphere release plugs within the lid thereby allowing liquid flow when the dual separated spout is in use and securing an airtight secure seal when the dual separated spout is in a closed position.

8. The canteen beverage container of claim 1 further comprising: a pair of atmosphere release plugs disposed underneath the dual separated spouts; and a pair of corresponding atmosphere release vent holes for engaging with the pair of atmosphere release plugs within the lid thereby allowing liquid flow when the dual separated spout is in use and securing an airtight secure seal when in the dual separated spout is in a closed position.

9. The dual container of claim 1, further comprising a stainless steel clip sleeve has a generally U-shape with an internal elongated space and a pair of perpendicular extensions, the internal elongated space is slid over the non-removable partition between the pair of opposing dual chambers with the length of the internal elongated space corresponding to the length of the non removable partition and the pair of perpendicular extensions extend perpendicularly across each of the pair of opposing dual chambers.

10. The dual container of claim 1, wherein the pair of stainless steel clip inserts each includes an elongated vertical stem and a pair of perpendicular extensions, the elongated vertical stems are inserted into the rectangular space between the non-removable partition with the length of the internal elongated space corresponding to the length of the non-removable partition, the pair of perpendicular extensions extend perpendicularly across the top of each of the pair of opposing dual chambers.

* * * * *